US005937725A

United States Patent [19]

Kamijo et al.

[11] Patent Number: 5,937,725

[45] **Date of Patent: *Aug. 17, 1999**

[54] LAMINATED SHEET CUTTING METHOD

[75] Inventors: Noriyuki Kamijo, Suwa; Kenji Watanabe, Tokyo; Takanobu Kameda, Tokyo; Chieko Aida, Tokyo; Tomoyuki Shimmura, Tokyo, all of Japan

[73] Assignees: Seiko Epson Corporation; King Jim Co., Ltd., both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/579,322

[22] Filed: Dec. 27, 1995

[30] Foreign Application Priority Data

Dec. 27, 1994 [JP] Japan ..... 6-326482
Nov. 10, 1995 [JP] Japan ..... 7-292816

[51] Int. Cl.[6] ..... B26D 3/08; B26D 7/26

[52] U.S. Cl. ..... 83/880; 83/881; 83/56

[58] Field of Search ..... 83/880, 879, 881, 83/861, 13, 56, 48

[56] References Cited

U.S. PATENT DOCUMENTS

| | | | |
|---|---|---|---|
| 3,292,513 | 12/1966 | Palmer | 83/880 X |
| 3,314,339 | 4/1967 | Guffy et al. . | |
| 3,777,604 | 12/1973 | Gerber . | |
| 4,245,538 | 1/1981 | Kammann et al. | 83/880 |
| 4,457,199 | 7/1984 | Corcoran | 83/880 X |
| 4,494,435 | 1/1985 | Lindsay | 83/880 |
| 4,503,744 | 3/1985 | Garner et al. | 83/879 |
| 4,512,839 | 4/1985 | Gerber | 83/880 X |
| 4,732,069 | 3/1988 | Wood et al. | 83/879 X |
| 4,854,205 | 8/1989 | Anderka | 83/881 X |
| 4,920,495 | 4/1990 | Pilkington | 83/880 X |
| 4,934,236 | 6/1990 | Gordon . | |
| 5,160,573 | 11/1992 | Takagi et al. | 83/879 X |
| 5,275,077 | 1/1994 | Kobayashi . | |
| 5,515,758 | 5/1996 | Bechmann | 83/880 |

FOREIGN PATENT DOCUMENTS

| | | | |
|---|---|---|---|
| 0 188 822 | 7/1986 | European Pat. Off. . | |
| 196383 | 10/1986 | European Pat. Off. | 83/56 |
| 0 231 820 | 8/1987 | European Pat. Off. . | |
| 319209 | 6/1989 | European Pat. Off. . | |
| WO 89/11806 | 12/1989 | European Pat. Off. . | |
| 0 607 026 A3 | 7/1994 | European Pat. Off. . | |
| 0 661 142 A2 | 7/1995 | European Pat. Off. . | |
| 57-98837 | of 1982 | Japan . | |
| 1293024 | 2/1987 | U.S.S.R. | 83/880 |

*Primary Examiner*—M. Rachuba
*Assistant Examiner*—Charles Goodman
*Attorney, Agent, or Firm*—Loeb & Loeb LLP

[57] ABSTRACT

A laminated sheet cutting method and apparatus for making consistent cuts partially through a laminated sheet without requiring high precision control of the cutter cutting depth are provided. The method for cutting partially through an adhesive tape comprising a base tape and a backing paper cuts only the base tape of the adhesive tape to a particular planar shape without cutting the backing paper. The adhesive tape is placed on a flexible member with the backing paper of the adhesive tape in contact with flexible member. The adhesive tape is held immobile on flexible member. The cutter having a beveled cutting edge is then pressed into the flexible member with the leading edge of the cutting edge descending to a specific cutting depth. The cutter is moved relative to the adhesive tape to cut only the base tape.

21 Claims, 12 Drawing Sheets

LAMINATED SHEET CUTTING METHOD

BACKGROUND OF THE INVENTION

1. Field of the Invention

This invention relates generally to a method and apparatus for cutting only the base sheet of a laminated sheet, such as an adhesive tape which comprises an adhesive-coated base tape to which a backing sheet is applied.

2. Description of the Related Art

Tape printing apparatuses used for printing text and graphics to a tape-like sheet material have become widely available in recent years. The tape used in these apparatuses is typically an adhesive tape comprising an adhesive-coated base tape to which a backing material has been applied. After being printed on the surface of the base tape, the tape is typically cut to certain dimensions for use as a label. When the printed tape, i.e., label, is then used, the backing tape is peeled off and the adhesive-coated label is applied to the desired part of the object. Because of the difficulty of peeling the thin label from the backing paper, these labels are often cut only partially relative to the thickness of the tape. More specifically, only the base tape is cut and the backing tape is left uncut, making it easier to separate the label from the backing paper.

A cutting method and apparatus of this type are described in Japanese utility model patent JIKKAI SHO57-98837 (1982-98837). This cutting method and apparatus describe a press-cutting method whereby a cutter is lowered vertically to the adhesive tape with the adhesive tape held stationery on a hard cutting bar.

With this conventional cutting method, it is necessary to adjust the cutting depth of the cutter with precision ranging from several microns to several ten microns because of the need to cut only the tape (and adhesive) without cutting the backing paper. Correspondingly high precision is therefore required in the construction and control of the apparatus, and maintaining the stability of the cutting precision is a common problem.

In addition, variations in the types and thickness of the materials used even in the same type of adhesive tape make it impossible to assure consistently reliable cutting depth precision even assuming the apparatus is constructed with sufficient precision.

Therefore, it is an object of the present invention to provide a laminated sheet cutting method and apparatus enabling consistent partial cutting of a laminated sheet without requiring high precision control of the cutter cutting depth.

SUMMARY OF THE INVENTION

To achieve the above object, the present invention provides a cutting method for cutting a laminated sheet, which comprises a backing sheet and a base sheet, into a predetermined planar shape such that only the base sheet is cut while the backing sheet is left uncut. In this method, the laminated sheet is pressed with the backing sheet facing and being in contact with a flexible member, which is used as a cutting bar. A cutter having a beveled cutting edge is moved relative to the laminated sheet at a cutting depth, such that the leading part of the cutting edge of the cutter reaches the flexible member.

When the cutter with a beveled cutting edge is moved to cut the laminated sheet held stationery against a flexible cutting bar by driving the cutter to a cutting depth at which the beveled cutting edge reaches the flexible member (cutter bar), the laminated sheet is cut by the cutting edge of the cutter while being pressed against the flexible member by the component force received from the cutting edge. This pressure causes the flexible member to flex while simultaneously flexing the laminated sheet pressed against the flexible member. As a result, the base sheet facing the cutter is cut while the backing sheet placed against the flexible member escapes from the cutter toward the flexible member and is not cut. Because the cutting depth of the cutter and the flexibility (hardness) of the flexible member work together to permit only partial cutting of the laminated sheet, the tolerance range of the cutter cutting depth is sufficiently great to assure that only the surface layer of the laminated sheet is cut. It is to be noted that the cutter cutting movement described above may also be reversed, i.e., the cutter side may be held immobile while the flexible member side is moved relative to the cutter. It is also possible to through-cut the laminated sheet by setting the cutter cutting depth to exceed the tolerance range assuring only partial cutting of the laminated sheet.

In the laminated sheet cutting method described above, the rigidity of the base sheet is preferably greater than the rigidity of the backing sheet. As a result, the backing sheet is flexed more than the base sheet by the component force received from the cutting edge of the cutter. This makes the base sheet easier to cut, and makes the backing sheet more difficult to cut because the backing sheet escapes toward the flexible member side as though separating from the base sheet.

In the laminated sheet cutting method described above, the surface of the flexible member is preferably adhesive or adsorptive. Movement of the laminated sheet pressed against the flexible member is thereby further inhibited, making it possible to hold the laminated sheet immobile with relatively little force pressing against the laminated sheet, and preventing the laminated sheet from shifting in response to the cutting action (cutting resistance) of the cutter.

In the laminated sheet cutting method described above, the hardness of the flexible member is preferably in the range 5~40 as measured using a JIS (Japan Industrial Standard) HS hardness gauge. The flexible member can thus be appropriately flexed by the component force from the cutting edge of the cutter, consistently creating the condition wherein the base sheet is cut and the backing sheet escapes toward the flexible member and is not cut. More specifically, this structure is able to increase the tolerance range of the cutter cutting depth assuring that only the surface layer of the laminated sheet is cut.

In the laminated sheet cutting method described above, the flexible member is preferably made from an ether urethane rubber. This composition makes the flexible member suitably soft while also being resistant to cutting, and imparts an appropriate stickiness to the flexible member.

In the laminated sheet cutting method described above, the flexible member preferably covers an area greater than the area covered by the laminated sheet at both the cutting start and cutting end positions of the cutter.

With this configuration, flexure of the flexible member can be made constant relative to the component force (pressure) applied by the cutting edge of the cutter at intermediate cutting positions between the cutting start and cutting end positions of the cutter. More specifically, if the edges of the flexible member and the laminated sheet are aligned, the component force acts on the flexible member only through a 180 degree range relative to the cutting point when the cutter cuts against the flexible member. If the flexible member covers an area extending beyond the edge of the laminated sheet, however, the component force is applied to the flexible member through a 360 degree range relative to the cutting point, and the flexible member flexes under the same conditions as at the middle.

In the laminated sheet cutting method described above, the hardness of the flexible member in one part corresponding to the cutting start and cutting end positions of the cutter is preferably greater than the hardness of the flexible member in another part corresponding to the intermediate cutting positions between the cutting start and cutting end positions.

Because of the resulting differences in the hardness of the flexible member at the different parts, the same cutting conditions can be obtained at the cutting start and cutting end positions of the cutter and the intermediate cutting positions. The reaction force of the flexible member at the cutting start and cutting end positions, where the cutting resistance is greater, can be made greater than the reaction force of the flexible member at the intermediate cutting positions. Deflection of the flexible member along the cutting path of the cutter can therefore be made constant, and more consistent partial cutting can be achieved.

In the laminated sheet cutting method described above, the relative cutting depth of the cutter to the flexible member is preferably deep at the cutting start and cutting end positions of the cutter, and shallow at the intermediate cutting positions.

Consistent partial cutting can therefore be achieved by effectively changing the cutting depth of the cutter. It is to be noted that this effective change in the cutting depth can be achieved by movement either on the cutter side or the flexible member side.

In the laminated sheet cutting method described above, the laminated sheet is preferably an adhesive tape in which a backing tape is applied to a base tape comprising an adhesive and a base material. The predetermined planar shape to which the laminated sheet is cut comprises curved corners at both sides in the widthwise direction of the adhesive tape, and a beveled edge connecting both curved corners in a straight line.

It is thus possible to partially cut the adhesive tape in a shape facilitating removal of the backing tape from the base tape, and to simultaneously shape (bevel) the cut edges of the adhesive tape.

A cutting apparatus according to the present invention for cutting a laminated sheet into a predetermined planar shape comprises a cutter having a beveled cutting edge with a leading part, a flexible member on which the laminated sheet is placed, a sheet holding means for holding the laminated sheet against the flexible member with the backing sheet of the laminated sheet facing the flexible member, a cutter holding means for holding the cutter in a manner such that the leading part of the cutting edge descends to a cutting depth reaching the flexible member, and a moving means for moving the cutter relative to the laminated sheet and flexible member to cut the laminated sheet into the predetermined planar shape.

By means of this configuration, the cutter having a beveled cutting edge is moved by the moving means relative to the laminated sheet held immobile against the flexible member by the sheet holding means to a cutting depth whereat the leading edge of the cutting edge reaches the flexible member. This causes the laminated sheet to be cut by the cutting edge of the cutter as the component force from the cutting edge presses the laminated sheet against the flexible member. This pressure also causes the flexible member to flex, causing the laminated sheet held tight thereto to also flex while the base sheet, which is positioned on the cutter-side of the flexible member, is cut. The backing sheet, which is positioned in contact with the flexible member, however, escapes from the cutter toward the flexible member, and is not cut. Because the cutting depth of the cutter and the flexibility (hardness) of the flexible member work together to permit only partial cutting of the laminated sheet, the tolerance range of the cutter cutting depth is sufficiently great to assure that only the surface layer of the laminated sheet is cut. It is also possible to through-cut the laminated sheet by setting the cutter cutting depth to exceed the tolerance range assuring only partial cutting of the laminated sheet. Because the cutter works against the flexible member, the noise associated with the cutting operation can also be reduced, and cutter damage and wear can be suppressed. It is to be noted that the cutter cutting movement described above may also be reversed, i.e., the cutter side may be held immobile while the flexible member side is moved relative to the cutter.

In the laminated sheet cutting apparatus described above, the rigidity of the base sheet is preferably greater than the rigidity of the backing sheet. As a result, the backing sheet is flexed more than the base sheet by the component force received from the cutting edge of the cutter. This makes the base sheet easier to cut, and makes the backing sheet more difficult to cut because the backing sheet escapes toward the flexible member side as though separating from the base sheet.

In the laminated sheet cutting apparatus described above, the surface of the flexible member is preferably adhesive or adsorptive. Movement of the laminated sheet pressed against the flexible member is thereby further inhibited, making it possible for the holding means to hold the laminated sheet immobile by applying relatively little force to the laminated sheet, and preventing the laminated sheet from shifting due to the cutting action (cutting resistance) of the cutter. Using an adhesive or adsorptive flexible member thus complements the holding function of the holding means.

In the laminated sheet cutting apparatus described above, the hardness of the flexible member is preferably in the range 5~40 as measured using a JIS (Japan Industrial Standard) HS hardness gauge. The flexible member can thus be appropriately flexed by the component force from the cutting edge of the cutter, consistently creating the condition wherein the base sheet is cut and the backing sheet escapes toward the flexible member and is not cut.

In the laminated sheet cutting apparatus described above, the flexible member is preferably made from an ether urethane rubber. This composition makes the flexible member suitably soft while also being resistant to cutting, and imparts an appropriate stickiness to the flexible member.

In the laminated sheet cutting apparatus described above, the flexible member preferably covers an area greater than the set position of the laminated sheet at both the cutting start and cutting end positions of the cutter.

With this configuration, flexure of the flexible member can be made constant relative to the component force (pressure) applied by the cutting edge of the cutter at intermediate cutting positions between the cutting start and cutting end positions of the cutter. More specifically, if the edges of the flexible member and the laminated sheet are aligned, said component force acts on the flexible member only through a 180 degree range relative to the cutting point when the cutter cuts against the flexible member. If the flexible member covers an area extending beyond the edge of the laminated sheet, however, the component force is applied through a 360 degree range relative to the cutting point, and the flexible member flexes under the same conditions as at the middle.

In the laminated sheet cutting apparatus described above, the hardness of the flexible member in one part corresponding to the cutting start and cutting end positions of the cutter is preferably greater than the hardness of the flexible member in another part corresponding to the intermediate cutting positions between the cutting start and cutting end positions.

Because of the resulting differences in the hardness of the flexible member at the different parts, the same cutting conditions can be obtained at the cutting start and cutting end positions of the cutter and the intermediate cutting positions, and the reaction force of the flexible member at the cutting start and cutting end positions, where the cutting resistance increases, can be made greater than the reaction force of the flexible member at the intermediate cutting positions. Deflection of the flexible member along the cutting path of the cutter can therefore be made constant, and more consistent partial cutting and through-cutting can be achieved.

The laminated sheet cutting apparatus described above preferably further comprises a cutting depth adjusting means for adjusting the cutting depth of the cutter relative to the flexible member. The cutting depth adjusting means adjusts the cutting depth in coordination with the cutting movement such that the cutting depth is deep at the cutting start and cutting end positions of the cutter and shallow at the intermediate cutting positions between the cutting start and cutting end positions.

Consistent partial cutting and through-cutting can therefore be achieved by the cutting depth adjusting means varying the cutting depth of the cutter.

In the laminated sheet cutting apparatus described above, the flexible member preferably has a uniform overall thickness, and the cutting depth adjusting means preferably includes a flexible member support base formed with the parts thereof corresponding to the cutting start and cutting end positions of the cutter being raised toward the cutter.

This configuration effectively achieves a means of adjusting the cutter cutting depth without creating additional moving parts.

In the laminated sheet cutting apparatus described above, the leading edge of the cutter reaching the flexible member is preferably not sharpened.

By not sharpening the leading edge of the cutter, partial cutting of the laminated sheet, i.e., cutting the base sheet without cutting the backing sheet, can be more reliably accomplished.

In the laminated sheet cutting apparatus described above, the sheet holding means preferably comprises a presser plate for pressing the laminated sheet to the flexible member. The presser plate preferably comprises a window along the path of cutter movement.

With this configuration, the area around the part of the laminated sheet to be cut is held firmly by the presser plate, effectively preventing unnecessary flexing or shifting of the laminated sheet during the cutting movement of the cutter.

In the laminated sheet cutting apparatus described above, the sheet holding means further comprises a presser plate operating mechanism for pressing the presser plate to the laminated sheet and releasing pressure from the presser plate. The presser plate operating mechanism operates in conjunction with the operation of the moving means to apply pressure to the presser plate during the cutting movement of the cutter, and to release the pressure on the presser plate before and after the cutting movement.

By means of this configuration, the laminated sheet can be quickly and easily set in position without impairing the holding performance of the laminated sheet.

In the laminated sheet cutting apparatus described above, the moving means preferably comprises a cutter holder for holding the cutter with the cutting edge oriented in the direction of movement, a holder drive means for driving the cutter holder in a rotational movement, a carriage for supporting the cutter holder and holder drive means, a carriage drive means for driving the carrier in a linear movement, and a control means for selectively controlling the holder drive means and the carriage drive means.

When the control means controls the holder drive means to move the cutter holder through a rotational movement, cutting in a circular or arc shape can be achieved. When the control means controls the carriage drive means to move the carriage through a linear path, cutting in a straight line can be achieved. As a result, the laminated sheet can be partially or through-cut in a variety of shapes combining arcs and straight lines. It is to be noted that the carriage drive means may be constructed to travel in both the X-axis and Y-axis directions.

In the laminated sheet cutting apparatus described above, the cutter is preferably fastened to the cutter holder in a manner enabling the cutter position to be adjusted radially to the cutter holder.

This configuration makes it possible to appropriately cut circle and arc shapes of different radii.

In the laminated sheet cutting apparatus described above, the holder drive means preferably comprises a holder drive motor and a worm fastened to the output shaft of the holder drive motor, and the cutter holder preferably comprises a worm wheel for meshing with the worm on the outer perimeter of the worm.

This construction transfers the drive power from the holder drive motor of the holder drive means to the cutter holder through the worm gear, and eliminates the effects of backlash resulting with common gears. More specifically, there is no play in the direction of cutter movement, and the cutter fastened to the cutter holder can be accurately driven through the cutting movement.

The laminated sheet cutting apparatus described above, further preferably comprises a spring forcing the cutter holder toward the flexible member.

The spring of this configuration forces the cutter toward the flexible member by means of the cutter holder, thereby eliminating the play of the cutter holder in the thrust direction and making it possible to maintain a constant cutter cutting depth.

In the laminated sheet cutting apparatus described above, the carriage drive means preferably comprises a carriage drive motor and a guide member guiding the linear movement of the carriage. A pinion is further mounted on the output shaft of the carriage drive motor, and the carriage comprises a rack engaging with the pinion.

This construction transfers motive power from the carriage drive motor to the carriage by means of the rack and pinion mechanism, thus simplifying the construction of the carriage drive means.

In the laminated sheet cutting apparatus described above, the guide member preferably includes a pair of round rod-like rails parallel to each other and disposed on opposing sides of the cutter; at least one rail of the pair of rails comprises an eccentric shaft part, such that the rail is supported by a support member at the eccentric shaft part and is rotatable relative to the support member.

Because that rail is supported by a support member at the eccentric shaft part in a manner enabling the rail to rotate relative to the support member, the position of the rail can be adjusted in an amount equal to twice the eccentricity of the shaft by rotating the rail to the support member. It is thereby possible to adjust the distance from the carriage to the flexible member by means of the rail. The cutter cutting depth can therefore be adjusted in fine increments. It is to be noted that because a pair of rails is disposed on opposing sides of the cutter, adjusting the movement of only one rail causes a 1/n part of that movement to be reflected in the cutting depth of the cutter.

In the laminated sheet cutting apparatus described above, the laminated sheet is preferably an adhesive tape comprising a backing tape applied to a base tape. The base tape includes an adhesive and a base material. The adhesive tape is set with the long sides thereof perpendicular to the direction of carriage movement. In addition, the control means moves the cutter by means of the holder drive means relative to the widthwise direction of the adhesive tape to cut a quarter circle from one side of the tape, then moves the cutter by means of the carriage drive means to cut a linear shape in a direction parallel to a short side of the adhesive tape, and finally moves the cutter by means of the holder drive means to form a quarter circle from the short side to the other long side of the tape.

With this configuration, the cut shape of the adhesive tape comprises curved corners at both sides in the widthwise direction of the adhesive tape, and a beveled edge connecting both curved side parts in a straight line. It is thus possible to partially cut the adhesive tape in a shape facilitating removal of the backing tape from the base tape, and to simultaneously shape (bevel) the cut edges of the adhesive tape. Note that the tape can, of course, also be through-cut in this same shape.

In the laminated sheet cutting apparatus described above, the cutter is preferably slightly away from the side of the adhesive tape at the quarter circle cutting start position and the quarter circle cutting end position.

This positioning creates an acute angle between tangent of the arc cut by the cutter and the side of the adhesive tape. While the resulting shape is therefore not cut to a complete quarter circle, this positioning prevents the cutting edge of the cutter from slipping along the side of the adhesive tape. It is also possible to effectively prevent interference between the adhesive tape and the cutting edge of the cutter due to variations in the placement of the adhesive tape at the cutting start and cutting end positions.

The laminated sheet cutting apparatus described above further preferably comprises an end regulating member for regulating the set position of the adhesive tape in the lengthwise direction of the tape.

The distance between the end regulating member and the path of cutter movement thus determines the dimension of the adhesive tape fingerhold that makes separation of the backing tape easy, and the fingerhold can thus be consistently dimensioned.

The laminated sheet cutting apparatus described above preferably further comprises a tape width detecting means for detecting the width of the inserted adhesive tape, and the control means preferably controls driving the carriage drive means based on the detection output from the tape width detecting means.

Partial cutting of the adhesive tape to form fingerholds for easily separating the backing tape according to the specific width of the adhesive tape, and shaping (beveling) of the adhesive tape, can thus be simultaneously and accurately accomplished, and adhesive tapes of differing widths can be appropriately shaped and cut.

In the laminated sheet cutting apparatus described above, the tape width detecting means preferably comprises: a side regulating member contacting one long side of the adhesive tape, a presser mechanism for pressing the other side of the adhesive tape to press the adhesive tape against the side regulating member, and an encoder for measuring the distance between the pressing end of the presser mechanism and the side regulating member based on the operation of the presser mechanism.

With this configuration, the presser mechanism presses one side of the adhesive tape against the side regulating member by pressing against the other side of the adhesive tape. The tape width detecting means can therefore be made to also function as a positioning means for positioning the side of the adhesive tape. The overall construction of the laminated sheet cutting apparatus can therefore be simplified.

In the laminated sheet cutting apparatus described above, the presser mechanism is preferably driven by the carriage drive motor. This further simplifies the overall construction of the laminated sheet cutting apparatus.

In the laminated sheet cutting apparatus described above, the cutter is preferably moved by the carriage drive motor from a home position to a cutting movement start position before the cutting movement begins, and the presser mechanism operates in conjunction with the movement of the cutter from the home position to the cutting movement start position.

As a result, the width of the adhesive tape is detected and the side of the adhesive tape is positioned while the cutter moves from the home position to the cutting movement start position. As a result, this sequence of operations can be quickly accomplished without affecting the cutting movement operation of the cutter.

In the laminated sheet cutting apparatus described above, the presser mechanism preferably comprises a contact arm comprising a pressing end on its one end and disposed in a manner allowing free movement in the direction of the short side of the adhesive tape, and a friction wheel disposed on the output shaft side of the carriage drive motor coaxially to the pinion and in contact with the contact arm. The friction wheel has a larger diameter than that of the pinion.

When a single drive power source is used for plural objectives with this configuration, the movement of the presser mechanism pressing the adhesive tape to the side regulating means occurs faster than the movement of the cutter. It is therefore possible to detect the width of the adhesive tape and position the side of the adhesive tape while the cutter moves from the home position to the cutting movement start position without using any other special means or devices. In addition, because drive power is transferred from the carriage drive motor via the friction wheel to the contact arm of the presser mechanism, the friction wheel slips after the presser mechanism presses the adhesive tape against the side regulating means. Positioning of the adhesive tape is thus held without interfering with carriage drive motor operation. The presser mechanism is also smoothly returned to the original (home position) in conjunction with the return of the cutter to the home position.

In the laminated sheet cutting apparatus described above, the presser mechanism preferably further comprises a spring pushing the contact arm toward the friction wheel. This spring assures reliable contact between the contact arm and the friction wheel.

In the laminated sheet cutting apparatus described above, the encoder preferably comprises a pit-and-land part formed on the contact arm, a detector switch contacting the pit-and-land part and switching on/off according to the movement of the contact arm to output a pulse signal, and a counter for calculating the distance between the pressing end of the presser mechanism and the side regulating member based on the pulse signal.

This configuration can reliably detect adhesive tapes of various specific widths by means of a simple construction.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
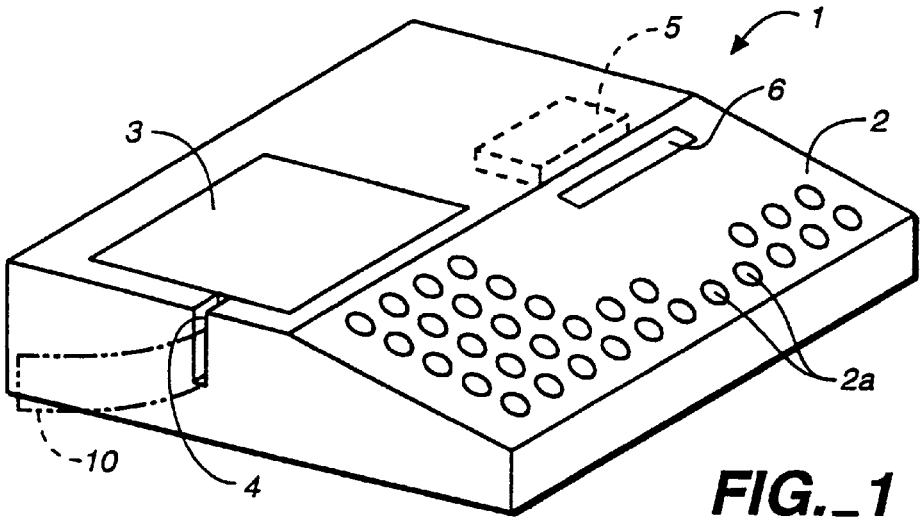
FIG. 1 is an external overview of a tape printing apparatus in which the laminated sheet cutting method and apparatus according to the first embodiment of the present invention are used.

In the drawings, like reference numerals refer to like parts.

The first embodiment of the present invention is described with reference to the accompanying FIGS. 1~14. FIG. 1 is an external overview of a tape printing apparatus for illustrating the laminated sheet cutting method and the laminated sheet cutting apparatus according to the first embodiment of the present invention.

As shown in FIG. 1, tape printing apparatus 1 comprises keyboard 2 having plural keys 2*a* at the front, and cover 3 at the back. Opening cover 3 exposes the tape cartridge and printer mechanism (neither shown in the figure) inside tape printing apparatus 1. Tape ejection opening 4 through which adhesive tape (laminated sheet) 10 passes after printing is completed is provided in the side of tape printing apparatus 1. Tape insertion opening 6, which leads to partial cutting means 5 housed inside tape printing apparatus 1, is provided at the front of tape printing apparatus 1.

After opening cover 3 and loading a tape cartridge to which the blank (unprinted) adhesive tape 10 of the desired width is wound, the user operates the desired keys 2*a* on keyboard 2 to input the required characters and print the input characters by a thermal transfer or other printing method to adhesive tape 10, which is fed at a constant rate. Transport of adhesive tape 10 stops when printing is completed. When adhesive tape 10 stops, the printed portion is exposed from tape ejection opening 4, and the user then cuts adhesive tape 10 by operating a manual or automatic cutter (not shown in the figure).

The cut adhesive tape 10 is an adhesive tape having a backing paper. The partial cutting method and partial cutting means 5 used to cut and shape the end of adhesive tape 10 to facilitate removal of the backing paper are described in detail below. To facilitate understanding of this partial cutting method and partial cutting means 5, the structure of adhesive tape 10 and the partially cut shape are described first below.

Figure 2:
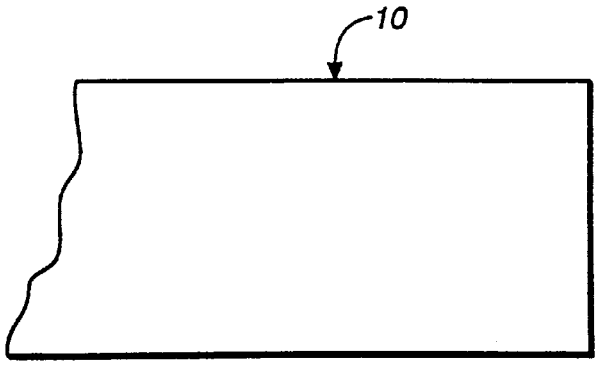
FIG. 2 is a plan view of an adhesive tape used in the present invention and the prior art.
Figure 3:
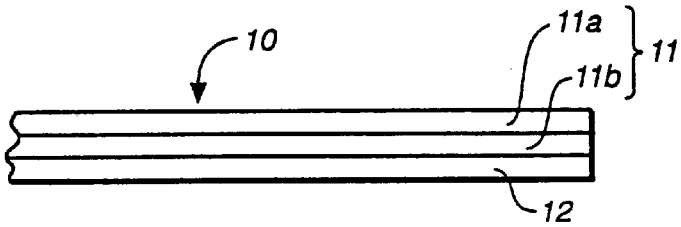
FIG. 3 is an enlarged side view of the adhesive tape shown in FIG. 2.

As shown in the plan view in FIG. 2 and the enlarged side view in FIG. 3, adhesive tape 10, which is a laminated sheet, comprises base tape (base sheet) 11 and backing paper (backing sheet) 12. Base tape 11 comprises base material 11*a* coated with adhesive 11*b*. Backing paper 12 is fixed to base tape 11 by this adhesive 11*b*. Base material 11*a* may be made from a PVC resin, polyester resin, polypropylene resin, or other such resin material; backing paper 12 is typically plain paper.

The characters input by the user are printed to the outside surface of base material 11*a*, and base tape 11 is applied as a label to the desired labeled object after trimming and peeling backing paper 12 from adhesive tape 10. Backing paper 12 is thus simply provided to prevent dust and other foreign matter from adhering to adhesive 11*b* until adhesive tape 10 (base tape 11) is used, and can be peeled from base tape 11 with relative ease. More specifically, backing paper 12 is coated with silicon or a similar material, and the adhesive strength of adhesive 11*b* to backing paper 12 is significantly less than the adhesive strength to base material 11*a*.

Figure 4:
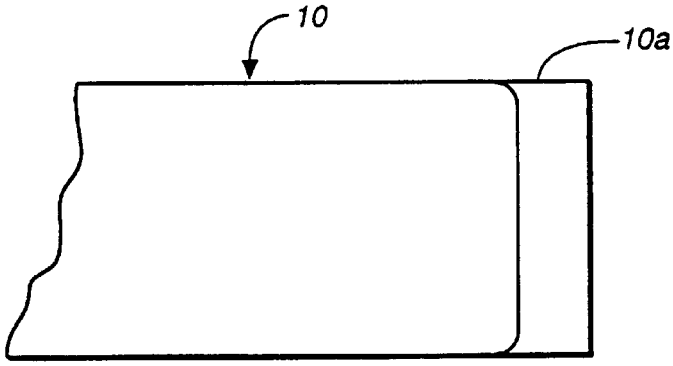
FIG. 4 is a plan view of an adhesive tape after being partially cut according to the present invention.
Figure 5:
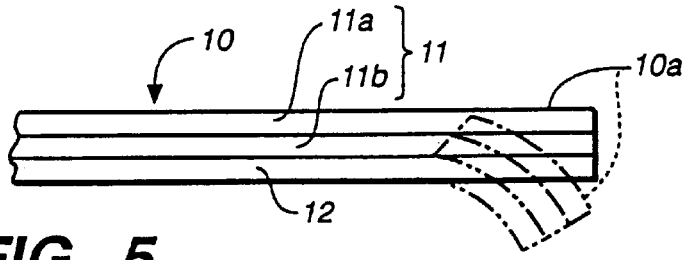
FIG. 5 is an enlarged side view used to describe the process of peeling the backing paper from the adhesive tape after cutting according to the present invention.

As commonly known, a means of grasping and peeling backing paper 12 from base tape 11 is therefore usually formed on adhesive tape 10. To accomplish this, partial cutting means 5 of the present invention cuts the end of adhesive tape 10 to form curved corners joined by a straight edge as shown in FIG. 4, simultaneously forming a finger-hold 10*a* for peeling backing paper 12 from adhesive tape 10 by cutting only partially through the thickness of adhesive tape 10 as shown in FIG. 5. The end of adhesive tape 10 is thus cut only through base tape 11, leaving backing paper 12 uncut. The user can then hold and bend fingerhold 10*a* back away from base tape 11, and easily separate backing paper 12 from base tape 11. It is to be noted that the end of adhesive tape 10 is not simply cut in a straight line, but is also cut with curved corners, i.e., trimmed, at this time.

When adhesive tape 10 is inserted to tape insertion opening 6 of tape printing apparatus 1 shown in FIG. 1 with the base material 11*a* side facing up, a sensor or switch (not shown in the figures) detects adhesive tape 10 insertion and activates partial cutting means 5. Partial cutting means 5 then partially cuts the end of adhesive tape 10 to the trimmed shape described above. After inserting adhesive tape 10 to tape insertion opening 6 to trim and partially cut both ends of adhesive tape 10, the user peels off backing paper 12 and applies the trimmed label (base tape 11) to the desired object.

The construction and operation of partial cutting means 5 are described next. When adhesive tape 10 is inserted to tape insertion opening 6, adhesive tape 10 is guided through guide path 21 leading from tape insertion opening 6 into partial cutting means 5 (see FIG. 10). The leading edge of adhesive tape 10 contacts positioning wall (end regulating member) 22 of frame 20 at this time, thus determining the insertion depth of adhesive tape 10 (see FIGS. 6 and 11).

Figure 10:
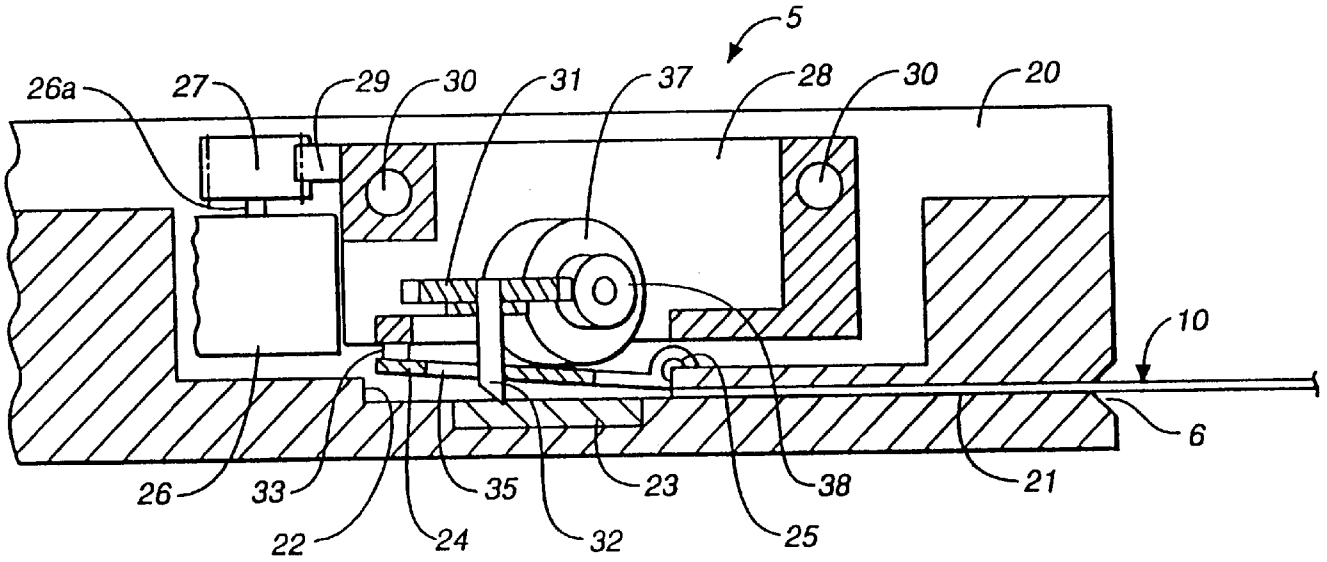
FIG. 10 is a partial side cross section view of the invention as shown in FIG. 6.

As shown in FIG. 10, presser plate 24 for pressing the inserted adhesive tape 10 toward flexible member 23 is provided at the end of guide path 21. Presser plate 24 is fastened to frame 20 by pivot pin 25 allowing presser plate 24 to rotate freely. Presser plate 24 is normally forced by a spring (not shown in the figure) in the direction releasing pressure on the inserted adhesive tape 10, i.e., up in FIG. 10. Because pressure is therefore normally not applied by presser plate 24, adhesive tape 10 can be easily inserted with minimal resistance. When adhesive tape 10 is fully inserted and the end of adhesive tape 10 contacts positioning wall 22 of frame 20, insertion of adhesive tape 10 is detected as described above and operation of carriage drive motor 26 begins.

Figure 6:
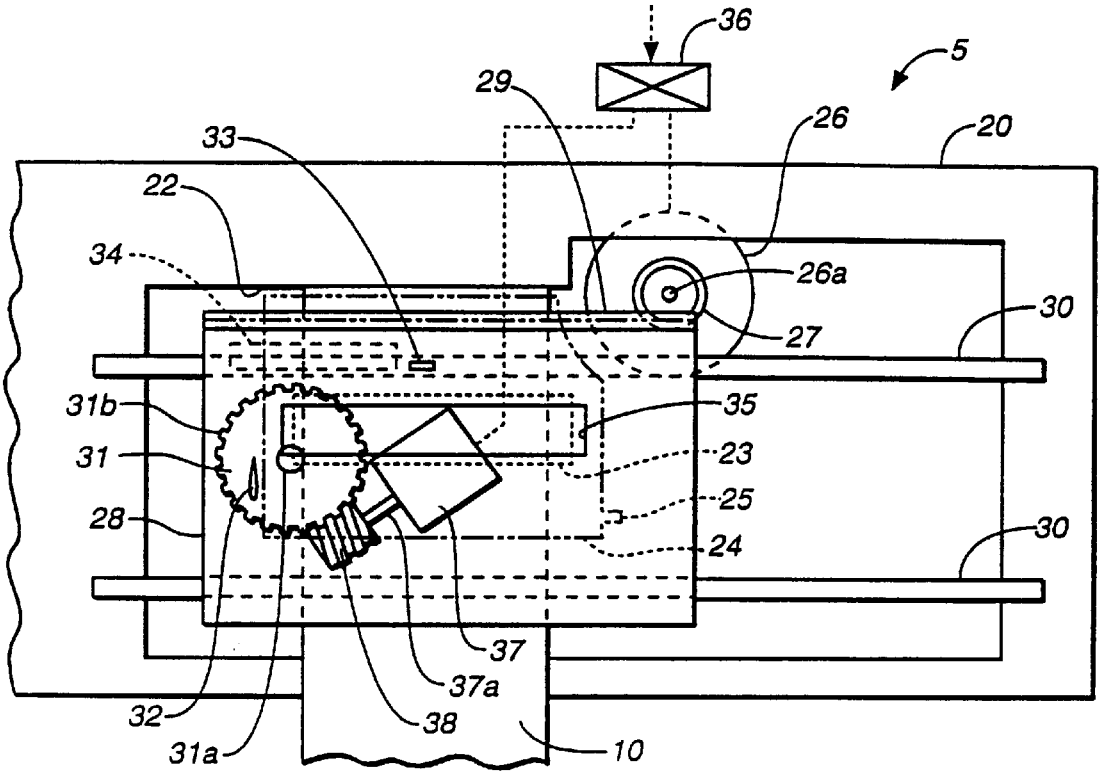
FIG. 6 is a plan view showing the cutting apparatus of the tape printing apparatus according to the present invention.
Figure 8:
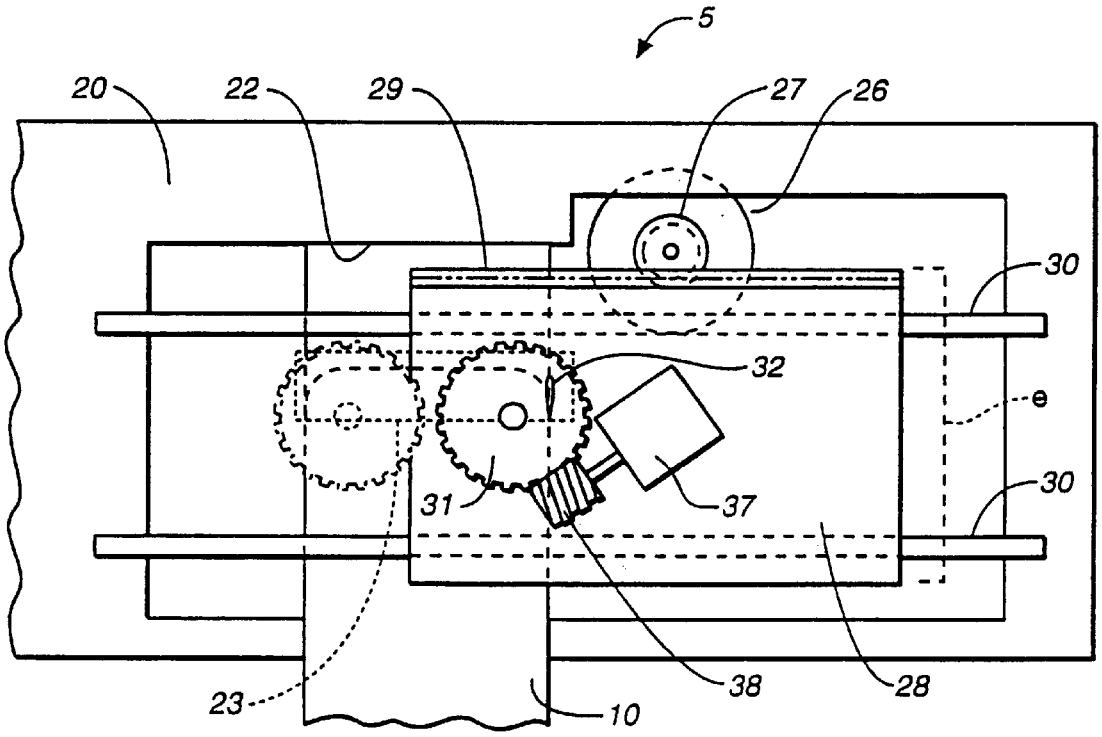
FIG. 8 is a plan view wherein the carriage has moved further to the right from the position shown in FIG. 7 according to the present invention.

Referring to FIG. 6, when carriage drive motor 26 operates, pinion 27 fastened to output shaft 26*a* of carriage drive motor 26 rotates. This pinion 27 is engaged with rack 29, which is formed on the side of carriage 28. As a result, operation of carriage drive motor 26 causes carriage 28 to move to the right in FIG. 6 guided by a pair of rails 30.

Figure 7:
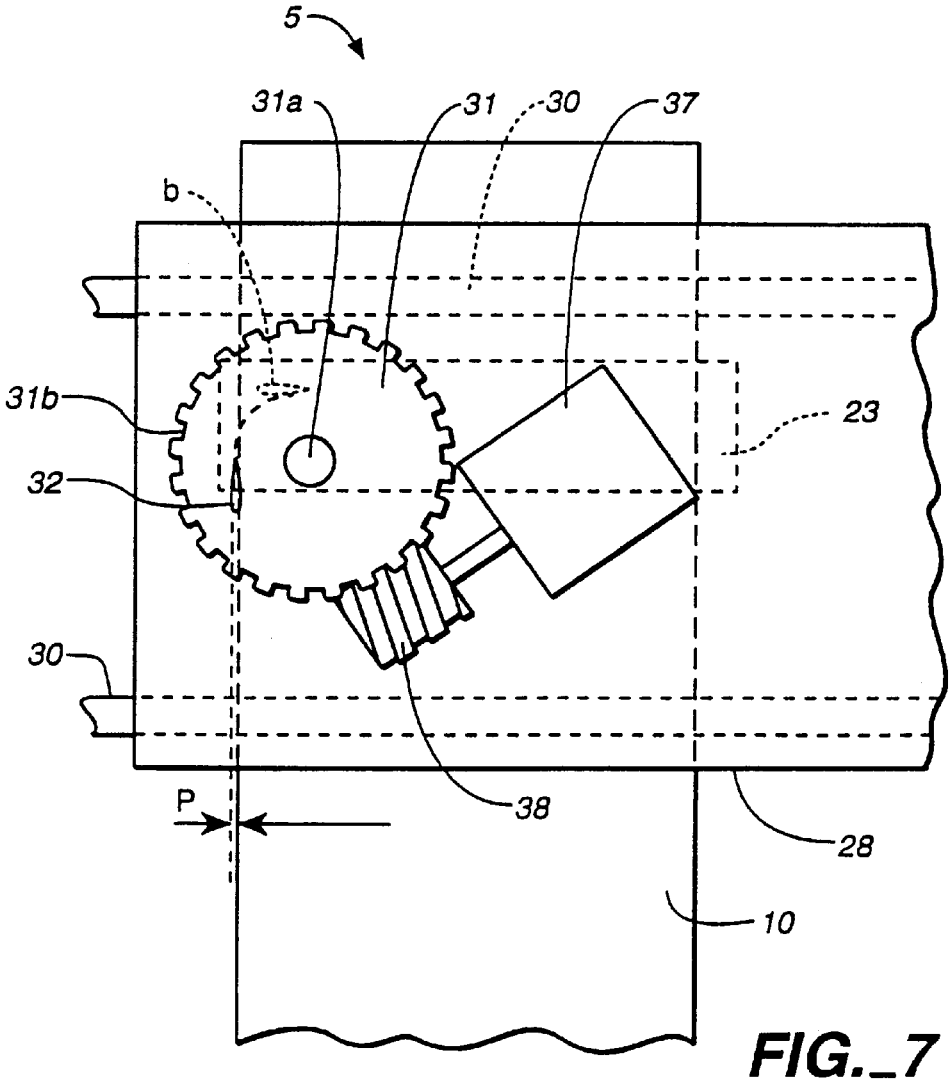
FIG. 7 is a partially enlarged plan view wherein the carriage has moved from the position shown in FIG. 6 to the left side of the adhesive tape according to the present invention.

A gear-shaped cutter holder 31 is provided in a freely rotating manner on the top of carriage 28. Cutter 32, which has a beveled cutting edge 32*a*, is fastened to cutter holder 31. As a result, when carriage 28 moves to the right, cutter 32 moves from the home position to the cutting movement start position. When in the cutting movement start position, cutter 32 is stopped with a nominal gap P to the left edge of adhesive tape 10 as shown in FIG. 7.

This gap P is set to prevent any contact between cutter 32 and the side of adhesive tape 10 even if there is some variation in the amount of linear movement of carriage 28, or if there is some variation in the widthwise position of the inserted adhesive tape 10. As a result, cutter 32 can be prevented from contacting adhesive tape 10 when cutter 32 moves to the cutting movement start position, shifting the position of adhesive tape 10 can be prevented, and cutter 32 can cut into adhesive tape 10 at an acute angle. It will be obvious that gap P is less than the rotational radius of cutter 32 referenced to center axis 31a of cutter holder 31.

Figure 14:
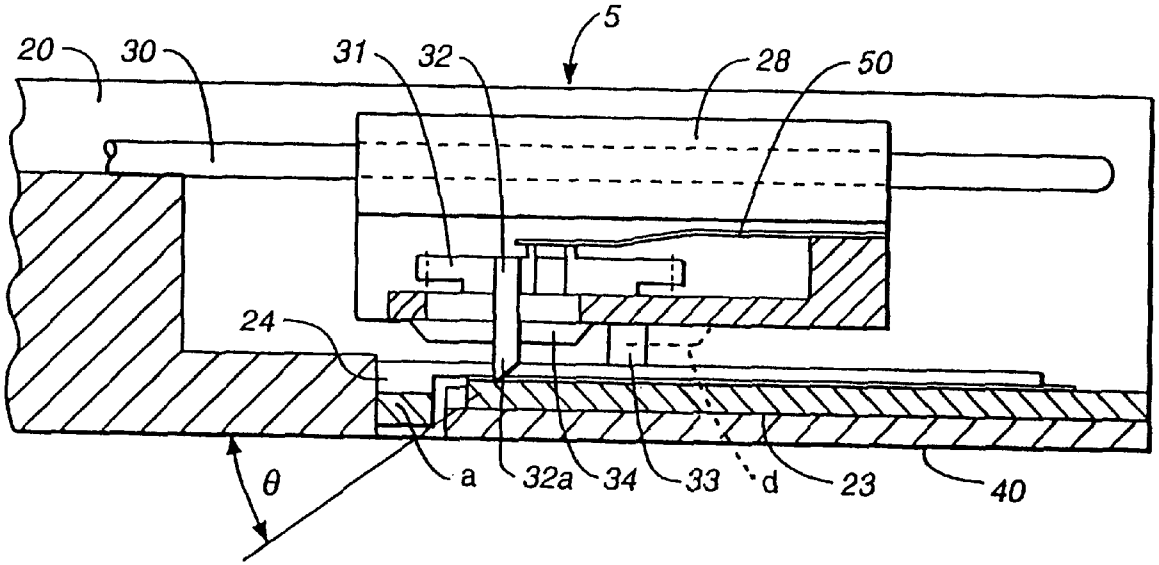
FIG. 14 is a partial side cross section view of the present invention.

As shown in FIGS. 6 and 14, projection 33 provided on the top of presser plate 24, and the incline (shown by the line in FIG. 14) of inclined member 34 on the back of carriage 28, are not engaged before linear movement of carriage 28 begins, i.e., when cutter 32 is in the home position. Presser plate 24 is therefore in the pressure-released state. After cutter 32 is moved to the cutting movement start position by the linear movement of carriage 28, projection 33 of presser plate 24 and inclined member 34 of carriage 28 engage, and presser plate 24 therefore applies pressure pressing adhesive tape 10 against flexible member 23.

Figure 11:
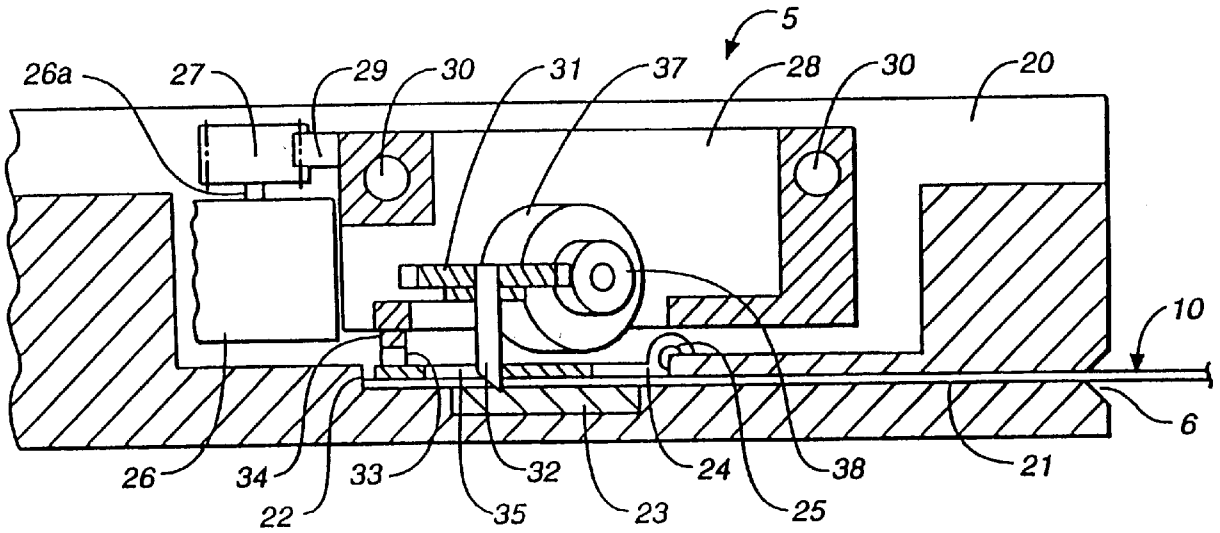
FIG. 11 is a partial side cross section view of the invention as shown in FIG. 7.

As shown in FIGS. 6, 10, and 11, window 35 is formed in the middle of presser plate 24 along the path of cutter 32 movement as described below; window 35 does not interfere with the cutting movement of cutter 32. The part of presser plate 24 passed by cutter 32 during the linear movement is formed in a recessed shape as shown by a in FIG. 14 so that cutter 32 does not interfere with presser plate 24 in this area. It is to be noted that a spring may also be provided between projection 33 and presser plate 24 as a means of pressing adhesive tape 10 to flexible member 23 with a constant force when presser plate 24 is positioned to press against adhesive tape 10.

Figure 12:
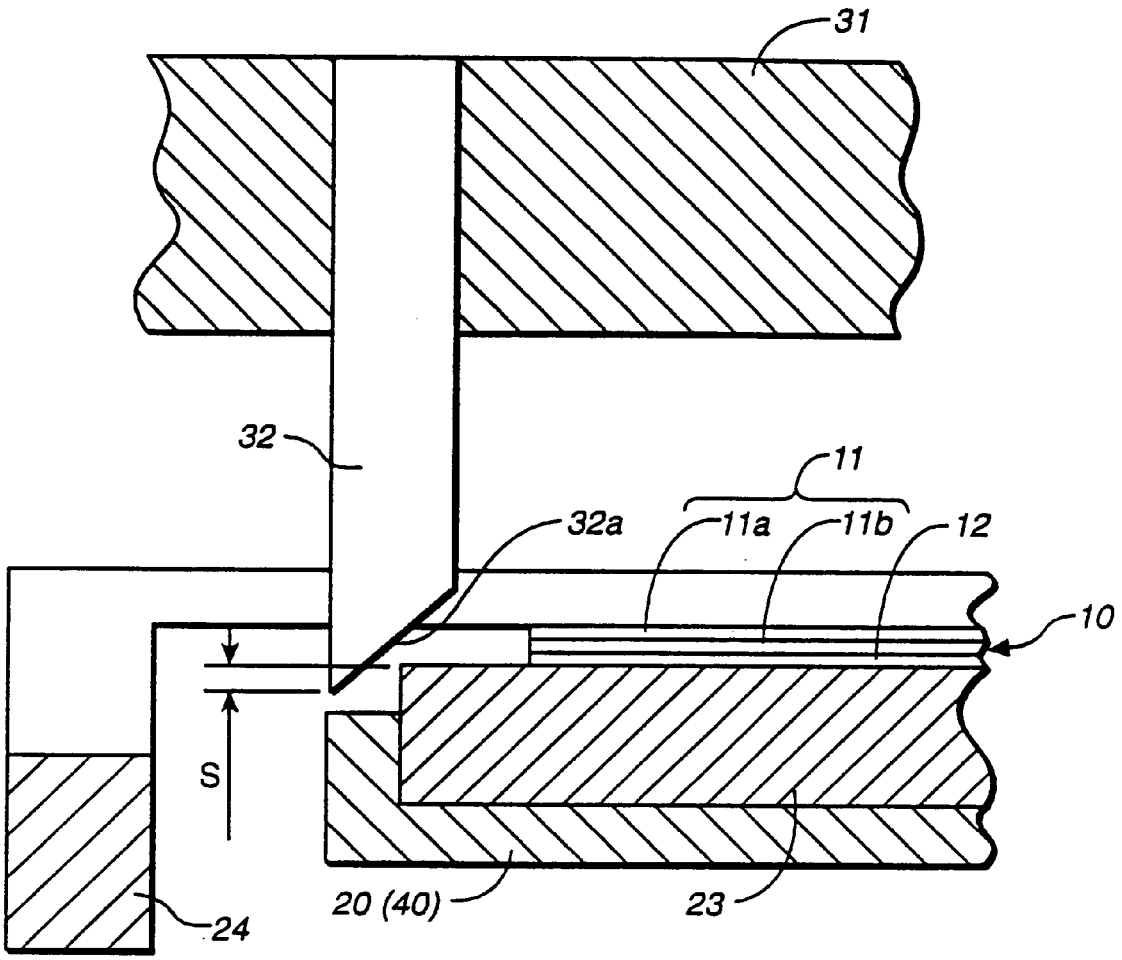
FIG. 12 is an enlarged side cross section view showing the relationship between the relative heights of the cutter, flexible member, and adhesive tape according to the present invention.
Figure 13:
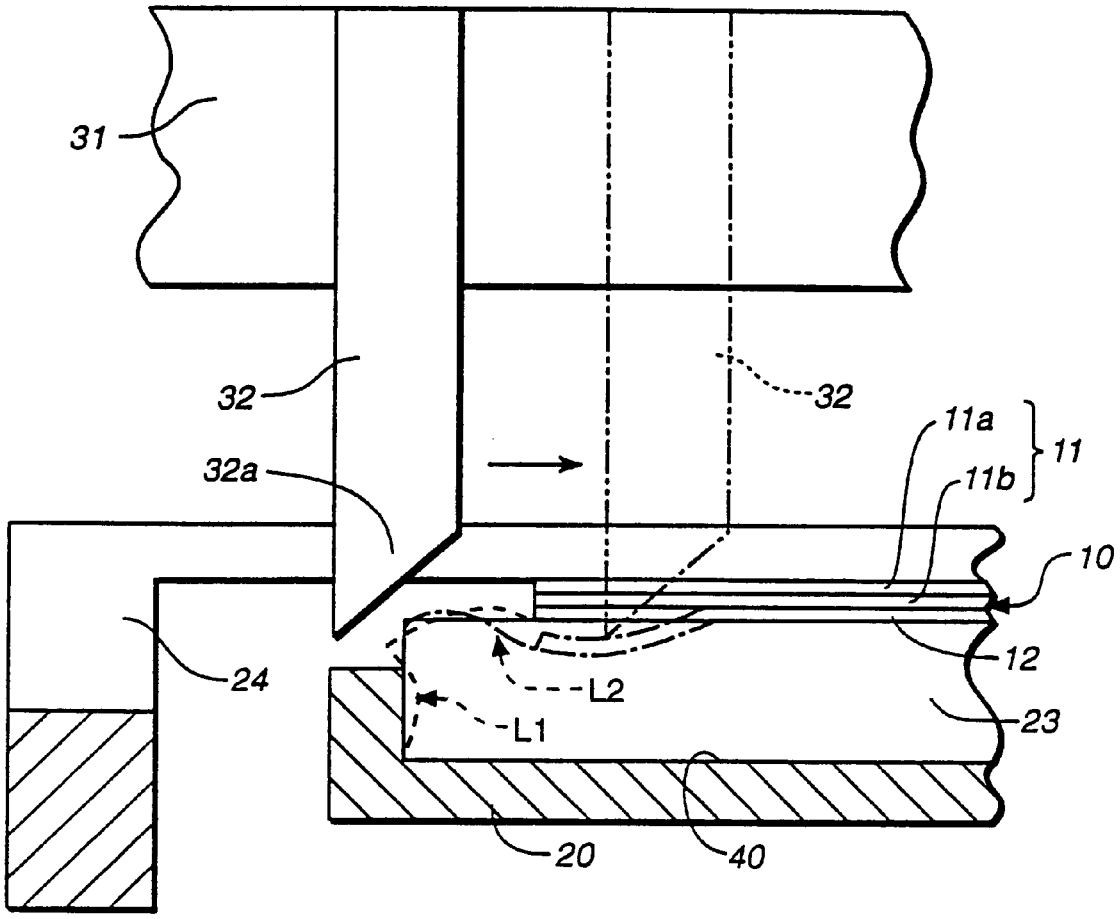
FIG. 13 is an enlarged side cross section view showing the flexible member at particular times during the operation of the cutter according to the present invention.

Flexible member 23 is made from an elastically compressible material, such as, a common ether urethane rubber with a hardness of approximately 20 as measured using a JIS HS-A hardness gauge. This material is generally known as an adhesive rubber and has a sticky surface. The stickiness of this adhesive rubber also tends to increase as the hardness of the rubber decreases. As a result, when presser plate 24 presses adhesive tape 10 against flexible member 23, backing paper 12 on the back side of the adhesive tape sticks to flexible member 23 as shown in FIG. 12. It is therefore not necessary for presser plate 24 to apply much pressure to adhesive tape 10; more specifically, presser plate 24 only needs to apply pressure sufficient to overcome the cutting resistance of cutter 32 as will be described below. Considering that the surfaces of adhesive tape 10 are a resin and plain paper, it should be noted that presser plate 24 is preferably made from a material that increases the friction between presser plate 24 and adhesive tape 10.

Once the operation holding adhesive tape 10 in place is completed, the operation partially cutting adhesive tape 10 begins. Note that carriage drive motor 26 and holder drive motor 37 described below are appropriately controlled by control apparatus 36 shown in FIG. 6.

When cutter 32 is in the cutting movement start position as shown in FIG. 7, carriage 28 is stopped and holder drive motor 37 begins to turn. Worm 38 is fastened to output shaft 37a of holder drive motor 37, and engages worm wheel 31*b* formed on the outside of cutter holder 31. As a result, when holder drive motor 37 operates, the worm gear formed by worm 38 and worm wheel 31*b* causes cutter holder 31 to rotate. The rotation of cutter holder 31 is set to approximately ninety degrees, thereby causing cutter 32 fastened to cutter holder 31 to cut an arc at one side in the widthwise direction of adhesive tape 10.

As shown in FIGS. 7 and 11, cutter 32 is fastened to cutter holder 31 with cutting edge 32*a* facing the direction of movement (i.e., tangentially to the rotational path), and is fastened with the leading edge of cutting edge 32*a* set to a cutting depth reaching flexible member 23 as shown in FIG. 12. More specifically, the cutting depth of cutter 32 is set such that the leading edge of cutting edge 32*a* presses down from the bottom surface of adhesive tape 10 (the top surface of flexible member 23) by amount S as shown in FIG. 12.

It would seem that adhesive tape 10 will be cut completely through the thickness of adhesive tape 10 because of this cutting depth of cutter 32, but an essential feature of the present invention is the disposition of flexible member 23 below adhesive tape 10. Only base material 11*a* and adhesive 11*b* of adhesive tape 10 are thus cut by cutter 32, leaving backing paper 12 uncut, because of the operation of flexible member 23 described below.

Specifically, rotation of cutter holder 31 causes cutting edge 32*a* of cutter 32 to first contact the edge of flexible member 23 (see FIGS. 7 and 12). Flexible member 23 is thus deformed as indicated by line L1 in FIG. 13 by the contact resistance of cutter 32 and the component force accompanying the cutting movement. Flexible member 23 is deformed without being cut because (a) its hardness is controlled to approximately 20 as described above, making flexible member 23 pliable enough to deform, and (b) the use of an ether urethane material further enhances the deformability of flexible member 23. While tests have shown the above ether urethane material to be best suited for flexible member 23, the present invention is not so limited and flexible member 23 may be alternatively formed from a silicon rubber or other synthetic rubber material.

When cutter holder 31 further rotates and cutter 32 advances, cutting edge 32*a* of cutter 32 contacts the side of adhesive tape 10. Because cutter 32 is moving at high speed at this time, the cutting force of cutter 32 impacts suddenly against the side of adhesive tape 10. While this cutting force deforms flexible member 23 as shown by line L2 in FIG. 13, cutter 32 overcomes the cutting resistance and begins to cut adhesive tape 10.

Note that base tape 11 of adhesive tape 10 comprises a resin base material 11*a* having greater rigidity than that of the paper backing paper 12. As cutter 32 cuts into adhesive tape 10, base tape 11 therefore flexes relatively little while backing paper 12 flexes greatly together with flexible member 23. Base tape 11 is therefore cut while backing paper 12 escapes toward flexible member 23 as though separating from base tape 11, and backing paper 12 is therefore not cut. The result is that adhesive tape 10 is only partially cut through the thickness of the tape.

Because cutter 32 and flexible member 23 thus work together so that adhesive tape 10 is only partially cut, the cutting depth of cutting edge 32*a* of cutter 32 is preferably set to a deep position reaching flexible member 23. As a result, dimension S may be any amount whereby flexible member 23 is elastically deformed and backing paper 12 is pushed away from cutting edge 32*a* by the force applied by cutter 32 when adhesive tape 10 is placed on flexible member 23. It follows that the tolerance range for dimension S increases as the hardness of flexible member 23 decreases, i.e., the tolerance range increases as the softness of flexible member 23 increases. To further ensure that the adhesive tape is cut only part way through the thickness thereof, it is possible to not sharpen that part of cutting edge 32*a* of cutter 32 that contacts backing paper 12.

The cutting operation described above is described more specifically below based on the experimental results shown in FIG. 24.

In this experiment base material 11*a* of adhesive tape 10 was made from polyethylene terephthalate (PETP), and backing paper 12 was plain paper. Adhesive tape 10 was 0.15 mm thick, including 0.05 mm thick base material 11*a*, 0.025 mm thick adhesive 11*b*, and 0.075 mm thick backing paper 12. Cutting edge 32*a* of cutter 32 was beveled at 35 degrees to the horizontal. Various flexible members 23 made from ether urethane rubber compounds ranging in hardness from 10~60 were used. The tolerance range enabling cutter 32 to only partially cut the adhesive tape as described above was then obtained for cutting depth S into flexible members 23 of various hardness ratings.

Figure 24:
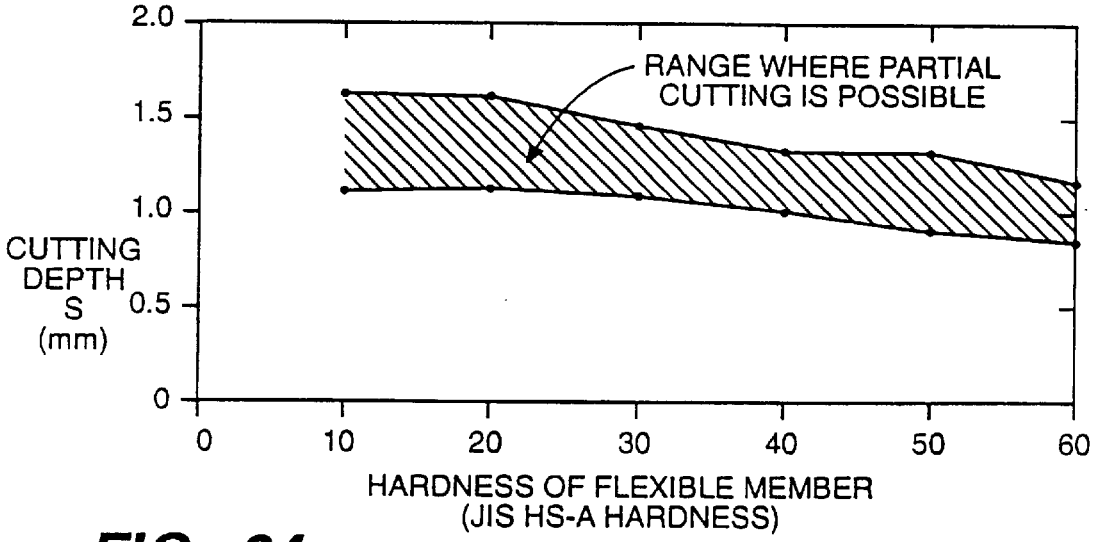
FIG. 24 is a graph of experimental results showing the relationship between the cutter cutting depth and the partial cutting tolerance range.

As shown by the results graphed in FIG. 24, the tolerance range for cutting depth S increases (to approximately 0.5 mm) when the hardness of flexible member 23 is low, and decreases (to approximately 0.3 mm) when the hardness of flexible member 23 is high. A greater cutting depth S is also required when the hardness of flexible member 23 is low than when the hardness is high. Considering deterioration of flexible member 23 with age, a wide tolerance range for cutting depth S is preferred, and considering adhesive force, a flexible member 23 with a low hardness rating is preferred. The preferred hardness of flexible member 23 is therefore in the range 5~40.

It should be noted, however, that good partial cutting is still possible when the hardness of flexible member 23 exceeds 40. This is because the tolerance range for cutting depth S is on the order of 0.1 mm (100 microns), which is a significantly greater tolerance range than the several micron to several ten micron tolerance range of the prior art. As will also be known from this experiment, cutting all the way through adhesive tape 10 is possible if the cutting depth S is approximately 2 mm (the process of cutting all the way through adhesive tape 10 is described below).

When cutter 32 is rotated approximately 90 degrees by operation of holder drive motor 37 and cuts a curve at one side of adhesive tape 10, holder drive motor 37 stops and cutter 32 therefore stops temporarily at approximately position b in FIG. 7. Because cutting edge 32*a* of cutter 32 is positioned tangentially to the circular path of cutting edge 32*a* while cutting this curve, cutting edge 32*a* is constantly oriented toward the direction of cutter 32 movement without specifically controlling its orientation. As a result, when cutting the curve is completed, cutting edge 32*a* of cutter 32 is oriented for the linear cut made following the curve. It should be noted that a holding current is preferably constantly applied to holder drive motor 37 to prevent the position of cutting edge 32*a* of cutter 32 from shifting when moving from cutting the curve to linear cutting.

Carriage drive motor 26 is then driven to move carriage 28 to the right, i.e., to move cutter 32 in a straight line to the right (across the short dimension of the adhesive tape) and cut the end of adhesive tape 10 in a straight line continuing from the end of the curve. The end point of this straight line cut is determined with respect to the curve to be cut at the other (uncut) side of the adhesive tape. At the end point of the straight cut the cutting edge of cutter 32 is again facing the direction in which the curve is to be cut.

Figure 9:
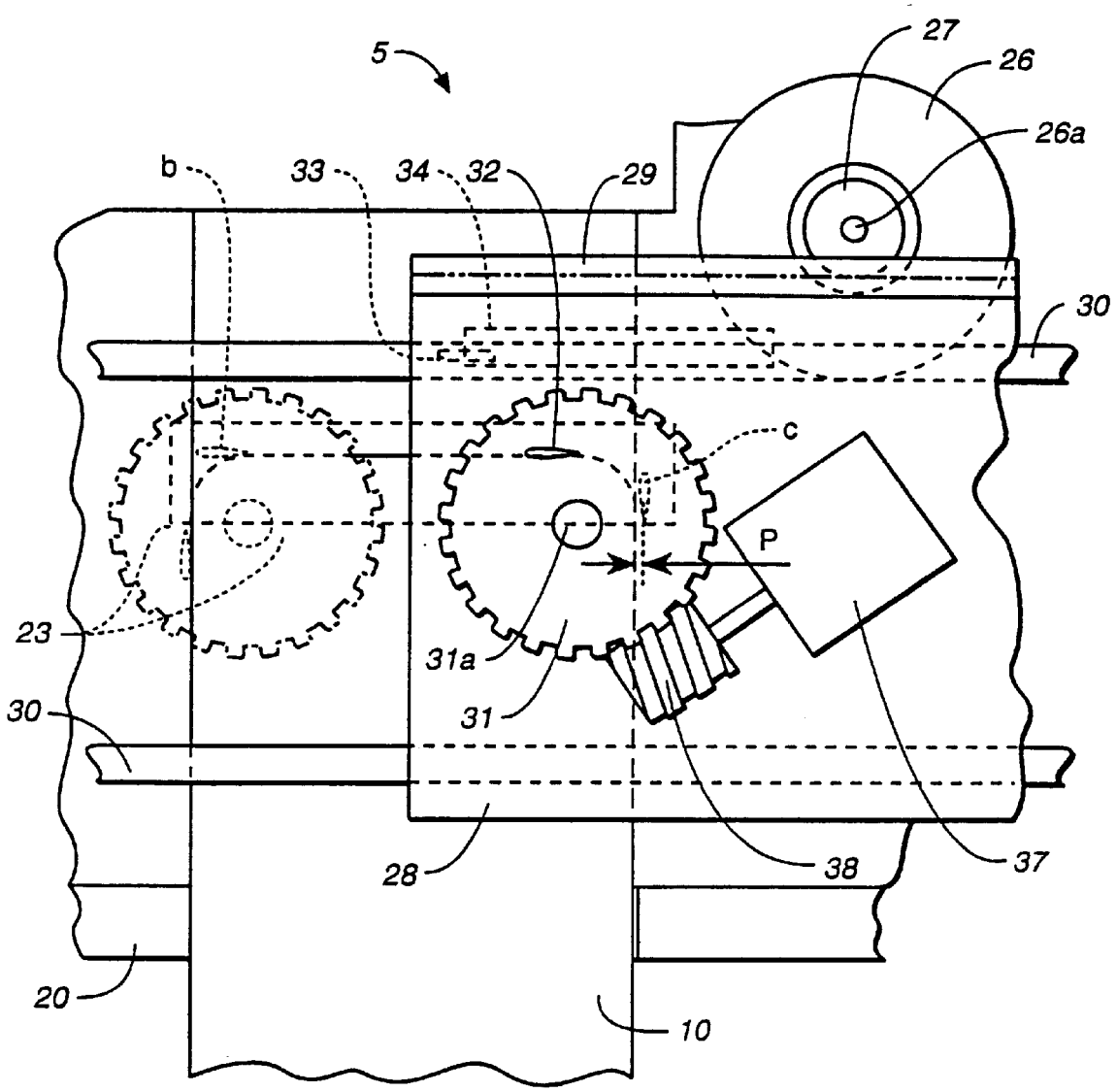
FIG. 9 is a partially enlarged view of FIG. 8.

The holder drive motor again operates to cut a curve from the short side (end) of adhesive tape 10 to the long right side of the tape as shown in FIG. 9. At end point c of the curve (FIG. 9), cutter 32 has overrun the right side of adhesive tape 10 by an amount equivalent to dimension P. This is to ensure that adhesive tape 10 is reliably cut through the curve even when there are variations or errors in the insertion positioning of adhesive tape 10, the tape width, or the home position of cutter 32. Note that dimension P is preferably equal at both right and left sides of adhesive tape 10 to improve the appearance of the cut adhesive tape 10.

During this cutting operation executed by cutter 32, projection 33 of presser plate 24 and inclined member 34 of carriage 28 are engaged as shown in FIGS. 9 and 11. Adhesive tape 10 is thereby pressed by presser plate 24 and held immobile against flexible member 23, and can be consistently cut without being moved by the cutting resistance of cutter 32.

After the second curve is cut, carriage drive motor 26 operates again to move cutter 32 to the right from the side of adhesive tape 10 as seen in FIG. 9. This moves the left side incline of inclined member 34 of carriage 28 to position d as shown in FIG. 14 (position e in FIG. 8). Projection 33 of presser plate 24 and inclined member 34 of carriage 28 are thus disengaged, presser plate 24 returns to the release position, and the user can easily remove adhesive tape 10 with a partially cut end from tape insertion opening 6.

EMBODIMENT 2

The second embodiment of the present invention is described below with reference to FIG. 15. In this embodiment, one of the pair of rails 30*a* and 30*b* in the first embodiment above, specifically rail 30b on the tape insertion opening side, is eccentrically mounted to the support member (not shown in the figures). More specifically, both outside ends of rail 30*b* form eccentric members 39, and rail 30*b* is mounted to the support member by means of these eccentric members 39.

Figure 15:
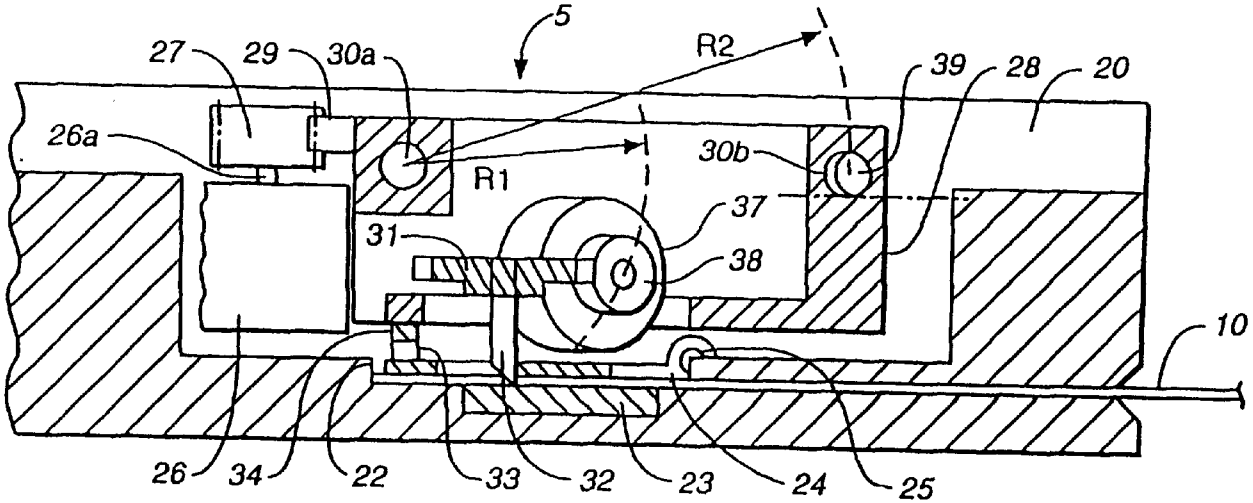
FIG. 15 is a side cross section view of an alternative embodiment of the present invention.

As a result, axial rotation of rail 30*b* on eccentric members 39 causes the right side of carriage 28 shown in FIG. 15 to move vertically with a vertical stroke twice the eccentricity of eccentric members 39. As a result, the edge of cutter 32 fastened to cutter holder 31 can also be moved vertically by means of carriage 28, and the cutting depth of cutter 32 can be adjusted in minute increments. Note that the axle holes in the support member are preferably long holes (the length of which is equivalent to twice the rail eccentricity) extending horizontally to prevent carriage 28 from moving sideways when eccentric members 39 rotate axially.

If, as shown in FIG. 15, the distance from the center of the one rail 30a to cutting edge 32*a* of cutter 32 is R1, and the distance from the center of this one rail 30a to the center of the other rail 30*b* is R2, the slight vertical movement of cutter 32 will be approximately (R1/R2) times the rail eccentricity. The value of (R1/R2) will always be less than 1 because rails 30*a* and 30*b* are disposed on opposing sides of cutter 32, and after the apparatus is assembled, the cutting depth of cutter 32 can be easily adjusted during mass production to compensate for variations in the thickness of flexible members 23, the straightness of rails 30*a* and 30*b*, the assembled height of cutter 32, and the hardness of flexible member 23.

The user is also able to make minor adjustments when replacing cutter 32, when cutting depth adjustment is required to compensate for temperature, humidity, or other environmental factors, and when using adhesive tapes of differing specifications. As a result, handling the laminated sheet cutting apparatus is extremely simple and the reliability of the apparatus can be greatly improved, in addition to the tolerance range for the cutting depth enabling partial cutting being great.

In addition, rack 29 is provided at the inside of carriage 28 away from tape insertion opening 6 as described above. As a result, using rail 30*b* positioned at the front of carriage 28 toward tape insertion opening 6 to make slight adjustments will not adversely the meshing of rack 29 and pinion 27.

Both rails 30*a* and 30*b* can also be made as described above to be adjustable.

EMBODIMENT 3

Figure 16:
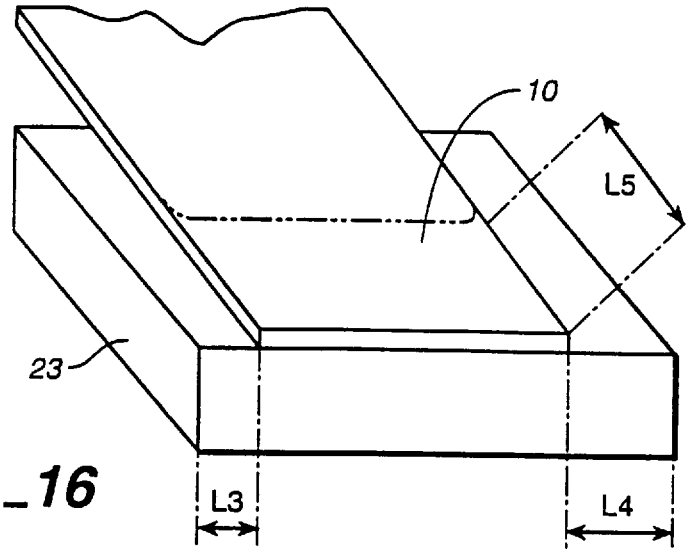
FIG. 16 is an overview showing the relationship between the adhesive tape and the flexible member according to the present invention.

The third embodiment of the present invention is described below with reference to FIGS. 7, 9, and 16. Note that as shown in FIGS. 7, 9, and 16, adhesive tape 10 is placed on flexible member 23, and flexible member 23 is larger than adhesive tape 10 by a margin equal to L3, L4, and L5 around the cut part of adhesive tape 10. More specifically, flexible member 23 is sufficiently wider than adhesive tape 10.

Because cutter 32 and flexible member 23 work together in partial cutting means 5 of the preferred embodiments described above so that adhesive tape 10 is only partially cut, flexible member 23 functions both to allow backing paper 12 to escape from the cutting edge so that it is not cut, and to prevent base tape 11 from not flexing excessively, thereby assuring that base tape 11 is cut. Furthermore, the rigidity of flexible member 23 is lower at the cutting start and cutting end positions than in the intermediate cutting positions, and adhesive tape 10 is therefore flexed more easily by the force applied by the cutter (the component force of the cutting force). Therefore, this third embodiment forms flexible member 23 with margins L3, L4, and L5 so that the component force from cutter 32 is always received by a constantly wide area (the same volume of flexible member 23), thereby preventing the cutting start and cutting end positions (both being side areas) of adhesive tape 10 from bending excessively.

Cutting resistance is high and the tape is difficult to cut at the cutting start position in particular because there is no force created by the thickness of cutter 32 acting to tear the tape. To therefore achieve consistent partial cutting in this area, a structure whereby the cutting depth is greater at the cutting start and cutting end positions of adhesive tape 10 preferably complements the margins provided in flexible member 23.

Figure 17:
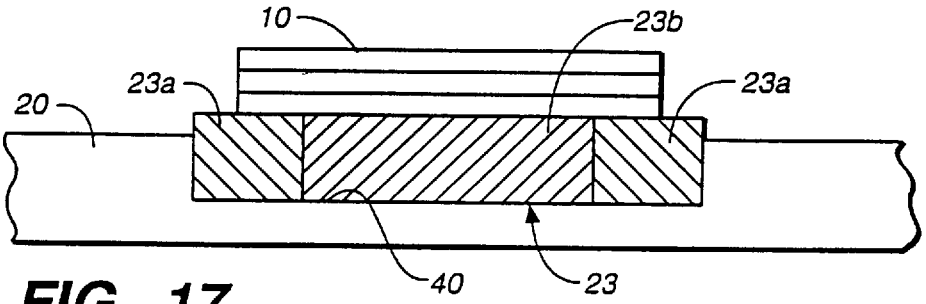
FIG. 17 is a partial cross section view showing an alternative embodiment of the flexible member according to the present invention.

The structure shown in FIG. 17 may be used to achieve this. In this alternative embodiment, flexible member 23 comprises hard members 23a and soft member 23*b*. Hard members 23*a* are used in at least the areas corresponding to the adhesive tape cutting start and cutting end positions, and soft member 23*b* is used in the area corresponding to the intermediate cutting positions between the cutting start and cutting end positions, to enable consistent partial cutting at all parts of adhesive tape 10. Note that it is even more desirable for the hardness of hard member 23*a* on the cutting start side of the adhesive tape to be higher than the hardness of hard member 23*b* on the cutting end position side of the tape.

Figure 18:
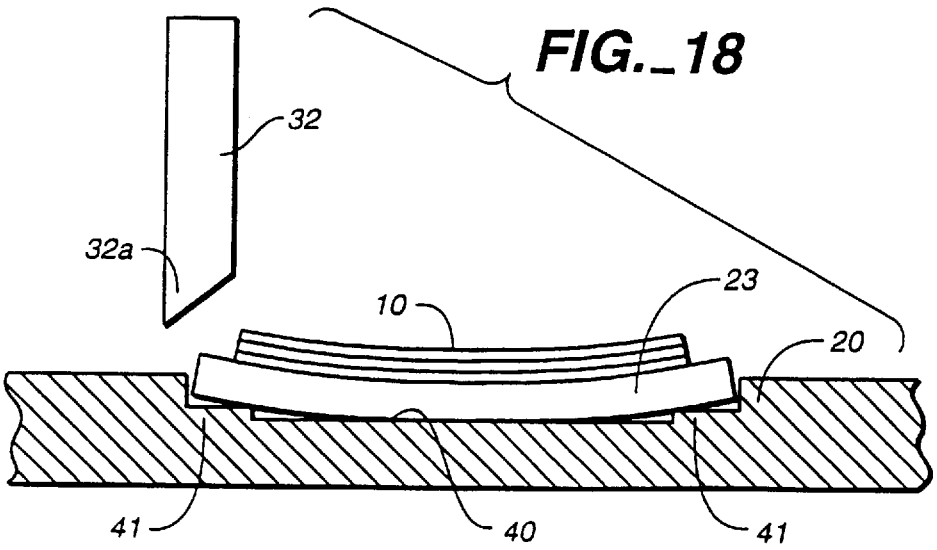
FIG. 18 is a partial cross section view showing another alternative embodiment of the flexible member according to the present invention.

A further alternative embodiment achieving a variable rigidity structure is shown in FIG. 18. In this embodiment, flexible member support base 40 of frame 20 supporting flexible member 23 is formed with the areas corresponding to the sides of adhesive tape 10 stepped higher than the middle area corresponding to the intermediate cutting area. Flexible member support base 40 is formed as a recess into frame 20 matching the planar shape of flexible member 23. Stepped members 41 formed at both sides of flexible member support base 40 cause the sides of flexible member 23 placed thereon to rise toward cutter 32, and adhesive tape 10 is then placed on flexible member 23. This causes adhesive tape 10 to be cut more deeply at the cutting start and cutting end positions than at the points therebetween, and results in consistent partial cutting.

As a result, even if flexible member 23 is greatly deformed by the component force applied when cutting the sides of adhesive tape 10, this deformation of flexible member 23 compensates for the deformation of adhesive tape 10, and prevents such cutting errors as partial cutting of the side parts of adhesive tape 10 not being completed.

As a further alternative embodiment effectively achieving the above construction, it is also possible to appropriately raise or lower cutter 32 or flexible member 23.

When various different widths of adhesive tape 10 may be used, plural stepped (raised) members 41 are also preferably provided to accommodate these various tape widths. While backing paper 12 may also be cut at the raised members between stepped members 41 corresponding to the cutting start and cutting end positions of a given tape width, this cutting of backing paper 12 will not interfere with peeling backing paper 12 from base tape 11. Conversely, such a structure may be used to form either a perforated partial cut or a perforated through-cut to adhesive tape 10.

EMBODIMENT 4

Figure 19:
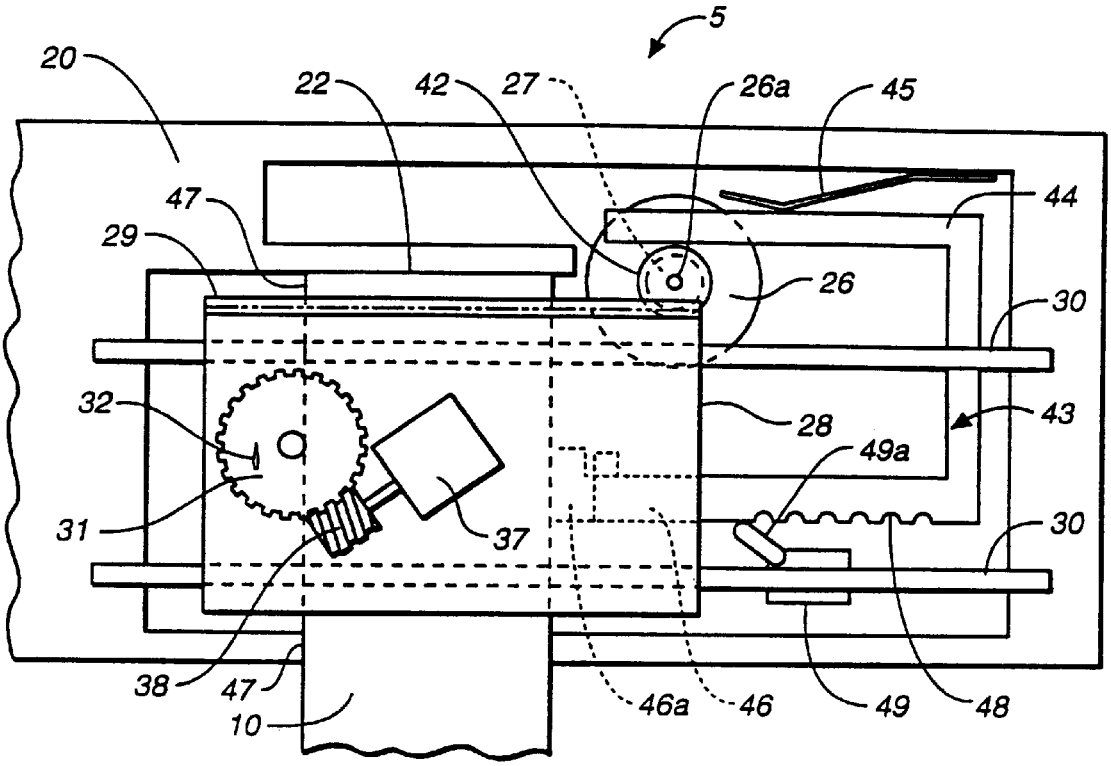
FIG. 19 is a partial plan view showing an example of the tape width detection mechanism according to the present invention.
Figure 20:
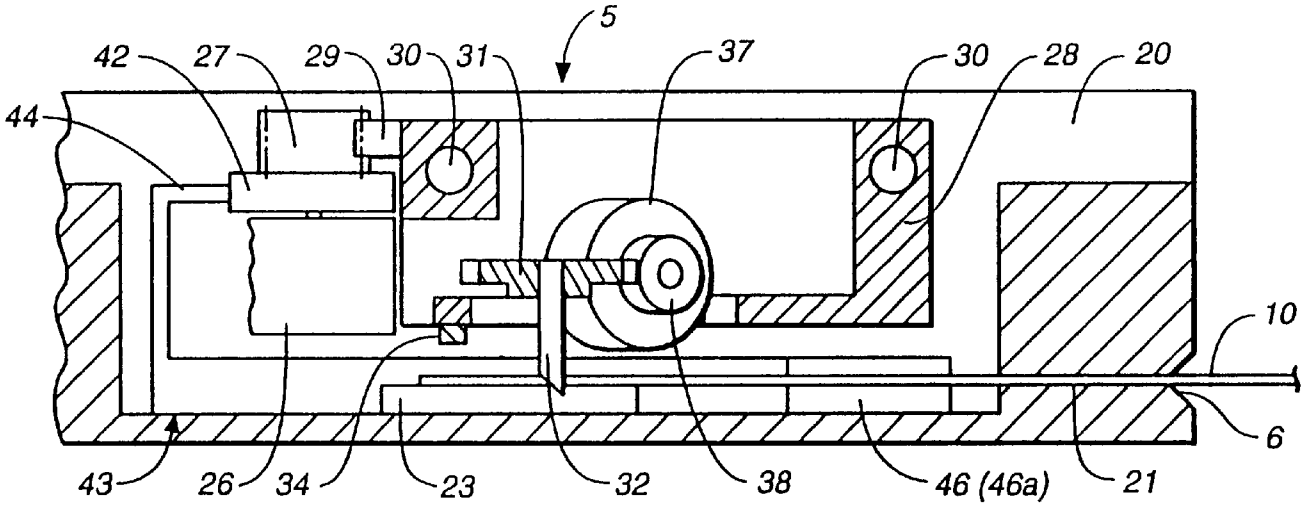
FIG. 20 is a partial side cross section view of FIG. 19.

The fourth embodiment of the present invention further comprising a means for detecting the width of adhesive tape 10 is described below with reference to FIGS. 19, 20, and 21. Note that like parts are identified by like reference numbers in these and the other figures.

When insertion of adhesive tape 10 to tape insertion opening 6 is detected, carriage drive motor 26 operates and carriage 28 moves to the right as seen in the figures, thereby moving cutter 32 from the home position to the cutting movement start position. Note that friction wheel 42 is further fastened on output shaft 26*a* of carriage drive motor 26 coaxially to pinion 27 in this embodiment, and contact arm 43 for detecting the tape width of adhesive tape 10 maintains physical contact with friction wheel 42 (see FIGS. 19 and 20). As a result, when carriage drive motor 26 turns, contact arm 43 moves to the left as seen in the figures.

Contact arm 43 is a U-shaped member disposed to frame 20 in a manner enabling contact arm 43 to travel freely along a known path. The inside surface of one arm member 44 of contact arm 43 contacts friction wheel 42 with pressure applied to the outside surface of arm member 44 by a plate spring 45 forcing arm member 44 against friction wheel 42. Plate spring 45 thus maintains constant contact between friction wheel 42 and contact arm 43. The end of the other arm member 46 of contact arm 43 is pressing end 46*a*. When contact arm 43 advances, pressing end 46*a* contacts one side (the right side in this example) of adhesive tape 10.

When carriage drive motor 26 turns to drive carriage 28 to the right with this configuration, contact arm 43 moves in the direction opposite carriage 28, i.e., to the left in this case. Because the outside diameter of friction wheel 42 is greater than that of pinion 27 as shown in FIGS. 19 and 20, contact arm 43 moves faster than carriage 28. This means that pressing end 46*a* of contact arm 43 will always contact the side of adhesive tape 10 while cutter 32 is moving from the home position to the cutting movement start position irrespective of the width of adhesive tape 10.

Because contact arm 43 thus advances after adhesive tape 10 is inserted to tape insertion opening 6, adhesive tape 10 can be reliably and smoothly inserted to positioning wall 22 without pressing end 46*a* of contact arm 43 interfering with adhesive tape 10 even when an adhesive tape of the greatest usable width is inserted.

Carriage drive motor 26 continues operating even after pressing end 46*a* of contact arm 43 contacts the side of adhesive tape 10, causing contact arm 43 to push against adhesive tape 10. This forces the left side of adhesive tape 10 against positioning walls 47. While contact arm 43 cannot advance further from this position, the continued operation of carriage drive motor 26 causes friction wheel 42 to slip, thereby holding contact arm 43 against adhesive tape 10. When cutter 32 reaches the cutting movement start position, carriage drive motor 26 stops, the width of adhesive tape 10 is detected as described below, and adhesive tape 10 is appropriately positioned.

This slipping of friction wheel 42 is an important operation maintaining the appropriate positioning of adhesive tape 10, and compensates for variations in the starting position of pressing end 46a of contact arm 43, variations in the width of adhesive tape 10, or variations in the outside diameter of friction wheel 42. It is to be noted that the present embodiment is designed for processing various widths of adhesive tape 10. This allows the user to use different widths of adhesive tape 10 for different applications, using, for example, large letters and a wide adhesive tape 10 to create large labels, or small labels and a narrow adhesive tape 10 to create small labels, as appropriate.

While various types of adhesive tape 10 can thus be used, the distance traveled by contact arm 43 is shortest when the inserted adhesive tape 10 is the widest usable adhesive tape 10. Excessive force resulting in excessive wear to mechanical parts is also prevented in this case because friction wheel 42 slips against contact arm 43.

After contact arm 43 presses against the side of adhesive tape 10 to position the tape widthwise, presser plate 24 presses down on adhesive tape 10 to position the tape in the thickness direction to complete positioning and holding the tape.

Figure 21:
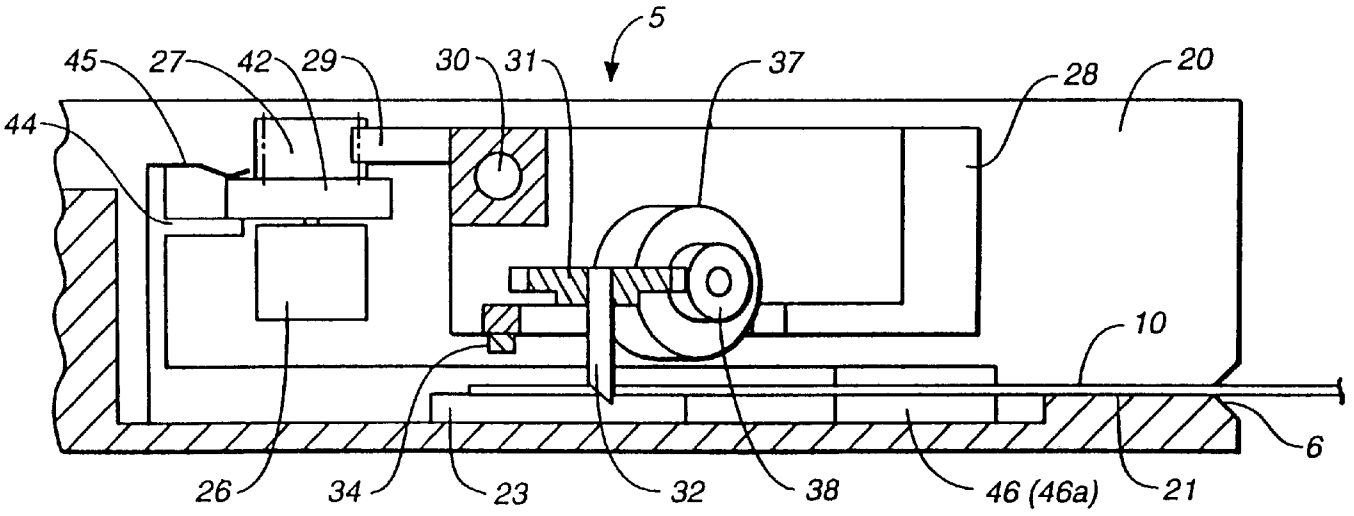
FIG. 21 is a partial side cross section view of an alternative embodiment of the tape width detection mechanism according to the present invention.

The contact structure shown in FIG. 21 may be alternatively used to increase the contact area between contact arm 43 and friction wheel 42. Specifically, plate spring 45 and the one arm member 44 of contact arm 43 both contact friction wheel 42 from opposite sides of friction wheel 42, thereby increasing the contact area between friction wheel 42 and contact arm 43, and stabilizing the operation of contact arm 43. This alternative configuration also permits carriage drive motor 26 to rotate smoothly because plate spring 45 does not apply any force acting on output shaft 26*a* of carriage drive motor 26 in the thrust direction.

EMBODIMENT 5

Contact arm 43 of the preceding embodiment also provides another important function, specifically, detecting the width of the inserted adhesive tape 10. When adhesive tape 10 is inserted as shown in FIG. 19, contact arm 43 is positioned as shown in the figure (i.e., at the home position all the way to the right in the figure), and advances from this position to move adhesive tape 10 against positioning walls 47. A series of pits and lands 48 is formed on the surface of the other arm member 46 of contact arm 43 as shown in the figure, and switch end 49*a* of width detection switch 49 contacts pits and lands 48. Switch end 49*a* of width detection switch 49 is forced towards pits and lands 48, and causes width detection switch 49 to switch on/off as switch end 49*a* contacts the pits and lands.

Thus, when contact arm 43 advances from the default position, width detection switch 49 turns on/off plural times and then stops. The number of on/off pulses is counted by a common counter (incorporated in the control apparatus described above) and compared with information stored in memory to detect the width of the inserted adhesive tape 10.

It is thus possible to detect the width of various types of adhesive tape 10 using an extremely simple mechanical structure consisting of a positioning contact arm 43 and width detection switch 49, simple electronic components, and commonly available electronic circuitry.

It is to be noted that the tape width detection mechanism comprising contact arm 43 and width detection switch 49 is essentially a type of encoder (linear encoder). It is therefore possible to substitute a variety of other common encoders, including optical encoders using LEDs or CCDs, for the tape width detection mechanism described above. In this case, it is possible to accurately measure the width of even non-standard adhesive tapes 10, and to reflect variations in the tape width of standard adhesive tapes 10 in the cutting operation (the cutting movement of cutter 32).

When the width of the inserted adhesive tape 10 is thus detected, the length of the linear cut connecting the two corner curves can be automatically calculated from the preset radius of the curves and the gap P shown in FIGS. 7 and 9. A drive pulse corresponding to the calculated linear cut length can then be applied to carriage drive motor 26 to accurately execute both curve cuts and the linear cut joining the curves for adhesive tapes 10 of different widths.

As a result, it is possible to eliminate both the need to have plural cutters for different tape widths, and the need to install the cutter appropriate to the width of the adhesive tape being processed. In addition, the continuous cutting operation is extremely efficient, a compact, low profile laminated sheet partial cutting apparatus can achieved, and cost can also be reduced.

EMBODIMENT 6

Figure 22:
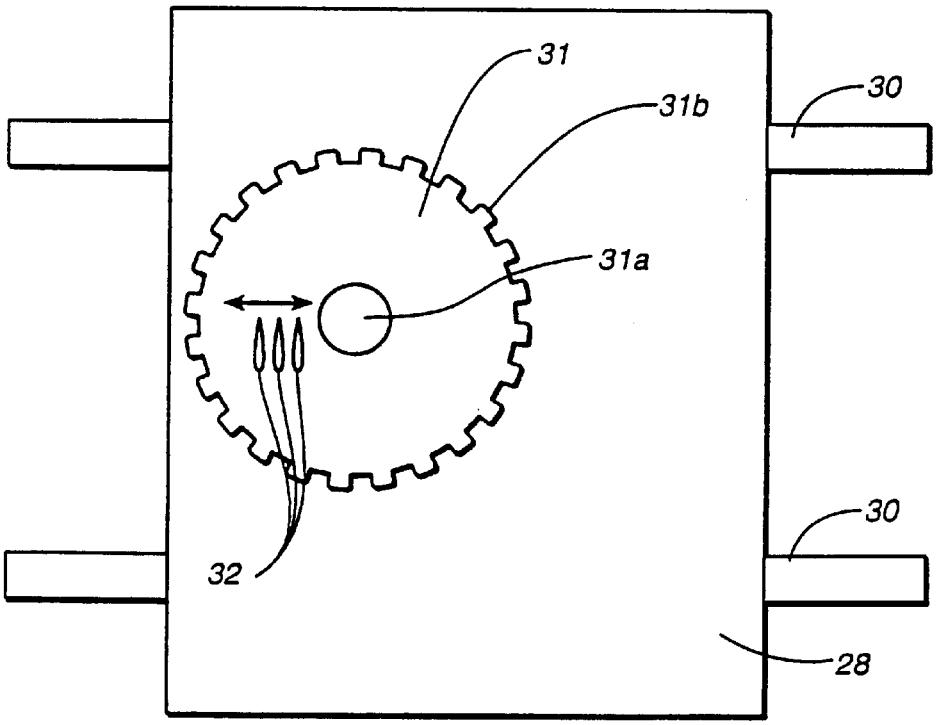
FIG. 22 is a partial plan view of an applied example of the present invention.

The sixth embodiment of the present invention is described next with reference to FIG. 22. In this embodiment, cutter 32 is disposed to cutter holder 31 mounted on carriage 28 in a manner allowing cutter 32 to move radially to cutter holder 31 (shown by the arrow in FIG. 22). Cutter 32 can be assembled to cutter holder 31 with a structure enabling cutter 32 to be moved manually, or automatically by means of some further mechanism not shown. This manual or automatic mechanism may also move cutter 32 either in steps or steplessly (continuously).

By thus enabling adjustment of the radial cutter position, the user can adjust the cutter to cut curves of a particular radius, and can thus select the shape to which the tape is trimmed. Note that the appearance of the trimmed tape can be improved by adjusting the radius (R) of the curves so that narrow adhesive tapes are trimmed with small radius curves and wide tapes are trimmed with large radius curves. This can be automatically achieved by applying the present invention to automatically set the size of the curve cuts appropriately to the width of the inserted adhesive tape 10, and automatically set the length of the linear cut according to the size of the curve cuts, when adhesive tape 10 is inserted.

EMBODIMENT 7

As shown in FIG. 14, the center of cutter holder 31 is pushed toward flexible member 23 by presser spring 50, one end of which is fastened to carriage 28.

As also described above, cutter 32 has a beveled cutting edge 32*a*, the angle of which is θ to the horizontal plane. This bevel reduces the cutting resistance of cutter 32, and causes flexible member 23 to flex during the horizontal cutting movement of cutter 32 due to the vertical component force of cutter 32 operation. As a result, flexible member 23 applies a reaction force corresponding to the received vertical component force to cutter 32 during the cutting movement. This reaction force works to lift cutter 32 during the cutting movement.

While this reaction force increases as angle 0 decreases, the cutter rises a distance equivalent to the play in the radial direction of cutter holder 31 to carriage 28, and it is possible that the desired cutting depth cannot be maintained. To prevent this, cutter 32 is constantly pushed downward by the spring pressure applied to cutter holder 31, eliminating the play in the radial direction of cutter holder 31 to carriage 28, and maintaining a constant cutting depth.

It should be noted that the pressure applied by presser spring 50 also works to brake rotation of cutter holder 31. This braking force is small, however, because presser spring 50 acts against the center of cutter holder 31, and does not work as a significant load impeding holder drive motor 37.

It is also possible for presser spring 50 to act directly on cutter 32.

Angle θ of cutter cutting edge 32*a* is also preferably in the range from approximately 15 degrees to approximately 75 degrees.

Note also that cutter 32 may be a double edged cutter considering the need to replace the cutter as the cutting edge wears. While cutter 32 can be replaced by fastening a separate cutter 32 to cutter holder 31, it is also possible to use an integrated cutter 32 and cutter holder 31, in which case cutter 32 and cutter holder 31 are replaced as a single unit.

EMBODIMENT 8

While the above embodiments have been described as a method and structure for partially cutting through the thickness of adhesive tape 10 to trim the adhesive tape and facilitate peeling backing paper 12 from the tape, the laminated sheet cutting apparatus of the present invention can also be used, as mentioned briefly in the description of the experimental results above, to cut completely through laminated sheets such as adhesive tape 10. Application of a cutting apparatus according to the present invention as applied in a so-called cutting plotter used to print and cut laminated sheets is described below as the eighth embodiment of the invention. Note that in addition to cutting a laminated sheet to a particular simple planar shape, this cutting plotter can also be used as a device for forming cut-out characters from a laminated sheet.

Figure 23:
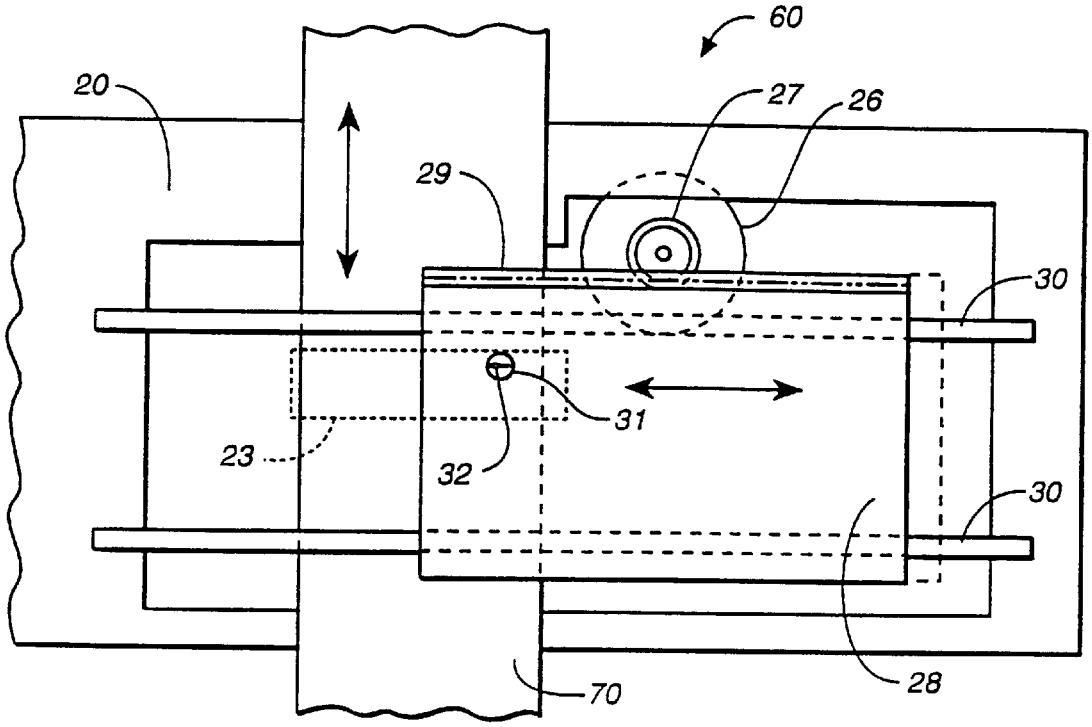
FIG. 23 is a partial summary plan view of the present invention as applied in a cutting plotter.

As shown in FIG. 23, laminated sheet 70 supplied to cutter 32 is transported in this cutting plotter 60 by a sheet feeding mechanism (not shown in the figure) forward and back perpendicularly to the direction of carriage 28 travel (see the arrows in FIG. 23). Both cutter 32 and laminated sheet 70 are thus able to move relative to each other in the X-axis and Y-axis directions. Note, further, that carriage 28 is driven by carriage drive motor 26 via rack 29 and pinion 27 as described in the preceding embodiments.

As also described above, cutter 32 is fastened to cutter holder 31, and cutter holder 31 can rotate freely on carriage 28. Cutting edge 32*a* of cutter 32 is automatically oriented to the cutting direction by the resistance received during the cutting movement because cutting edge 32*a* of cutter 32 is placed at a position eccentric to the rotational axis of cutter holder 31 and cutter holder 31 can rotate freely.

Cutter 32 can thus be moved to cut any desired shape by appropriately controlling, using a control apparatus not shown in the figures, the sheet feeding mechanism and carriage drive motor 26. More specifically, laminated sheet 70 can be through-cut to a particular shape, and letters, symbols, or graphics can be cut out from laminated sheet 70 as required. It will be obvious that laminated sheet 70 can also be only partially cut by adjusting cutter 32 to a shallow cutting depth.

While similar cutting plotters 60 used to create cut-out letters have been previously available, such cutting plotters 60 cut laminated sheet 70 against a hard resin member rather than against a soft flexible member 23 as in the present invention. Such cutting plotters 60 can be adjusted to partially cut laminated sheet 70, but the reliability of this partial cutting operation is extremely poor. Other drawbacks to such conventional cutting plotters 60 include a noisy cutting operation, easy damage to cutting edge 32*a* of cutter 32, and rapid wearing of cutter 32.

By cutting laminated sheet 70 against a soft flexible member 23, the present embodiment achieves a quiet cutting operation, inhibits damage to cutting edge 32*a* of cutter 32, and minimizes cutter 32 wear (i.e., enables a long cutter 32 service life). As also described above, the reliability of partial cutting operations is extremely high because of the greater tolerance flexible member 23 affords in the cutting depth of cutter 32 for partial cutting operations.

Alternatively to the configuration described above, the carriage 28 and cutter 32 assembly may be held stationery, and laminated sheet 70 placed on an X-Y table which is then moved for cutting. Conversely, laminated sheet 70 may be held stationery with cutter 32 mounted on an X-Y table which is then moved for cutting. The present embodiment may also be combined with the preceding embodiments in various ways, and such combinations shall also remain within the scope of the present invention.

With the configuration of the present embodiment described above, holder drive motor 37 is driven to cut the first curve in adhesive tape 10 after cutter 32 is moved to the right from the home position and positioned near adhesive tape 10. Carriage drive motor 26 is then driven to make the linear cut continuing from the curved cut, and the second curved cut continuing from said linear cut is then made. It will be obvious, however, that it is also possible with the present invention to partially or completely cut adhesive tape 10 to various other shapes, including a straight line with no curves or a straight line with only one curve.

In other words, the user may, for example, operate control apparatus (CPU) 36 to select only a straight cut when it is desired to simply trim the end of adhesive tape 10 in a straight line. Note, also, that when removal of adhesive tape 10 from tape insertion opening 6 is detected after the cutting operation is completed, holder drive motor 37 and carriage drive motor 26 are appropriately driven to return cutter 32 to the home position.

As described hereinabove, it is possible to accomplish both partial cuts and through-cuts by means of a high reliability, low cost configuration according to the present invention.

By means of the described method and configuration, it is possible to provide an information processing apparatus that is convenient and easy to use, and can be easily adjusted to cut shapes corresponding to the width of the adhesive tape or sheet without significantly permanently deforming the adhesive-backed adhesive tape as may occur with conventional laminated sheet cutting apparatuses; without impairing the external appearance of the cut adhesive tape; and without gradually causing the base tape to peel off from the object, after applying it to the object, as a result of the deformation of the adhesive tape when removing the backing sheet.

In particular, because the straight cut and the curved cut accomplished by rotating the cutter are completed continuously, efficiently, quickly, and reliably without separating the cutter from the laminated sheet during the cutting operation, the shape of the cut does not become ragged and is completed as a consistently clean line.

Furthermore, because the backing paper can be peeled away by grasping a large area at the end of the cut adhesive tape, the task of completely removing the backing paper from the laminated sheet or adhesive tape is particularly simple when compared with conventional methods whereby a small corner area must be lifted to peel away the backing paper.

In addition to the simplicity of the method and configuration of the present invention, high reliability and low cost can also be achieved because the flexure of the flexible member is significantly greater than any variation that may occur in the gap between the surface of the flexible member and the tip of the cutter. The flexure of the flexible member is thus able to compensate for any variation in this gap.

The method and structure of the present invention can also be achieved automatically or manually, and are therefore innovative.

The present invention also uses a cutter with a knife-like edge and cuts the adhesive tape with a slicing action rather than simply pressing the cutter into the adhesive tape as do conventional cutters. The invention is therefore able to cut the adhesive tape efficiently using a smaller cutting force.

The holding means also requires only a small holding force, and a compact, low-output motor can be used for the drive means. Power consumption is therefore low, and a compact, low-profile cutting apparatus can be achieved.

The present invention is also not limited to use with narrow tape-like media, and can be used with wide sheet-like media.

The method and configuration of the present invention are also not limited to making partial cuts in the processed media, and can be used for through-cutting. The method and configuration of the present invention are also not limited to processing the ends of sheet or tape media, and can be used in a cutting plotter as described above with the numerous beneficial effects also described above.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A method for cutting a laminated sheet which includes a backing sheet and a base sheet, the method comprising the steps of:

providing an elastically compressible member;

providing a cutter which has a beveled cutting edge, the cutting edge having a leading part;

pressing the laminated sheet with the backing sheet facing and being in contact with the elastically compressible member; and moving the cutter relative to the laminated sheet at a cutting depth such that the leading part of the cutting edge of the cutter locally depresses the elastically compressible member, to an extent that the laminated sheet is cut into a predetermined planar shape wherein the base sheet is cut while the backing sheet is left uncut.

2. The method claim 1 wherein the backing sheet has a rigidity and the base sheet has a rigidity which is greater than the rigidity of the backing sheet.

3. The method of claim 1 wherein the elastically compressible member has a periphery and, the method further comprises the step of placing the laminated sheet within the periphery of the elasticlly compressible member at both cutting start and cutting end positions of the cutter.

4. The method of claim 1 wherein the laminated sheet is an adhesive tape having a widthwise direction and two sides spaced apart in the widthwise direction, the base sheet is a base tape and the backing sheet is a backing tape applied to the base tape, and the base tape includes a base material and an adhesive and the adhesive is disposed between the base material and the backing tape; and wherein the predetermined planar shape includes two curved corners at the two sides of the adhesive tape in the widthwise direction of the adhesive tape and a beveled edge connecting the two curved corners in a straight line.

5. The method of claim 1 wherein the step of moving the cutter includes moving the cutter in a direction parallel to a median plane of the laminated sheet.

6. The method of claim 1, wherein the step of moving the cutter relative to the laminated sheet locally deforms the elastically compressible member about the leading part of the cutting edge of the cutter.

7. The method of claim 1, wherein the step of moving the cutter includes moving the cutter in a direction parallel to a median plane of the laminated sheet and locally deforming the elastically compressible member about the leading part of the cutting edge of the cutter.

8. The method of claim 1, wherein the step of moving the cutter includes moving the cutter in a direction parallel to a median plane of the laminated sheet and locally deforming the elastically compressible member about the leading part of the cutting edge of the cutter to thereby form a locally depressed area in a surface of the elastically compressible member.

9. The method of claim 1, wherein the step of moving the cutter relative to the laminated sheet locally deforms the laminated sheet and the elastically compressible member about the leading part of the cutting edge of the cutter to an extent that the cutting edge of the cutter reaches only the base sheet and does not reach the backing sheet and the elastically compressible member.

10. The method of claim 1, wherein the step of moving the cutter includes moving the cutter in a direction parallel to a median plane of the laminated sheet and locally deforming the laminated sheet and the elastically compressible member about the leading part of the cutting edge of the cutter to an extent that the cutting edge of the cutter reaches only the base sheet and does not reach the backing sheet and the elastically compressible member.

11. The method of claim 1, wherein the elastically compressible member moves away from the cutting edge of the cutter to allow the cutting edge of the cutter to reach only the base sheet and not to reach the backing sheet as the cutter is moved.

12. A method for cutting a laminated sheet which includes a backing sheet and a base sheet, the method comprising the steps of:

providing an elastically compressible member;

providing a cutter which has a beveled cutting edge, the cutting edge having a leading part;

pressing the laminated sheet with the backing sheet facing and being in contact with the elastically compressible member;

positioning the leading part of the cutting edge of the cutter at a cutting depth that reaches the elastically compressible member;

moving the cutter in a direction parallel to a median plane of the laminated sheet and locally depressing the laminated sheet and the elastically compressible member to allow the cutting edge to reach only the base sheet to cut the base sheet while leaving the backing sheet uncut.

13. The method of claim 12, wherein the step of moving the cutter includes forming a locally depressed area in a surface of the elastically compressible member being in contact with the laminated sheet, the locally depressed area in the surface of the elastically compressible member being spaced a distance from the cutting edge of the cutter.

14. The method of claim 13, wherein the step of moving the cutter includes forming a locally depressed area in each of the laminated sheet and the elastically compressible member and shifting the locally depressed area across a width of the laminated sheet to cut the base sheet while leaving the backing sheet uncut.

15. The method of claim 12, wherein the elastically compressible member moves away from the cutting edge of the cutter to allow the cutting edge of the cutter to reach only the base sheet and not to reach the backing sheet as the cutter is moved.

16. A method for cutting a laminated sheet which includes a backing sheet and a base sheet, the method comprising the steps of:

providing a flexible member, wherein the step of providing the flexible member includes providing an adhesive surface therewith;

providing a cutter which has a beveled cutting edge, the cutting edge having a leading part;

pressing the laminated sheet with the backing sheet facing and being in contact with the flexible member; and moving the cutter relative to the laminated sheet at a cutting depth such that the leading part of the cutting edge of the cutter reaches the flexible member, such that the laminated sheet is cut into a predetermined planar shape wherein the base sheet is cut while the backing sheet is left uncut.

17. A method for cutting a laminated sheet which includes a backing sheet and a base sheet, the method comprising the steps of:

providing a flexible member, wherein the step of providing the flexible member includes providing an adsorptive surface therewith;

providing a cutter which has a beveled cutting edge, the cutting edge having a leading part;

pressing the laminated sheet with the backing sheet facing and being in contact with the flexible member; and moving the cutter relative to the laminated sheet at a cutting depth such that the leading part of the cutting edge of the cutter reaches the flexible member, such that the laminated sheet is cut into a predetermined planar shape wherein the base sheet is cut while the backing sheet is left uncut.

18. A method for cutting a laminated sheet which includes a backing sheet and a base sheet, the method comprising the steps of:

providing a flexible member, wherein the step of providing the flexible member includes providing the flexible member with a hardness in a range of 5–40 as measured by a JIS (Japan Industrial Standard) HS hardness gauge;

providing a cutter which has a beveled cutting edge, the cutting edge having a leading part;

pressing the laminated sheet with the backing sheet facing and being in contact with the flexible member; and moving the cutter relative to the laminated sheet at a cutting depth such that the leading part of the cutting edge of the cutter reaches the flexible member, such that the laminated sheet is cut into a predetermined planar shape wherein the base sheet is cut while the backing sheet is left uncut.

19. A method for cutting a laminated sheet which includes a backing sheet and a base sheet, the method comprising the steps of:

providing a flexible member, wherein the step of providing the flexible member includes forming the flexible member from an ether urethane rubber;

providing a cutter which has a beveled cutting edge, the cutting edge having a leading part;

pressing the laminated sheet with the backing sheet facing and being in contact with the flexible member; and moving the cutter relative to the laminated sheet at a cutting depth such that the leading part of the cutting edge of the cutter reaches the flexible member, such that the laminated sheet is cut into a predetermined planar shape wherein the base sheet is cut while the backing sheet is left uncut.

20. A method for cutting a laminated sheet which includes a backing sheet and a base sheet, the method comprising the steps of:

providing a flexible member;

providing a cutter which has a beveled cutting edge, the cutting edge having a leading part;

providing a part of the flexible member corresponding to intermediate cutting positions with a hardness and a part of the flexible member corresponding to cutting start and cutting end positions of the cutter with a hardness greater than the hardness of the part of the flexible member corresponding to the intermediate cutting positions between the cutting start and cutting end positions;

pressing the laminated sheet with the backing sheet facing and being in contact with the flexible member; and moving the cutter relative to the laminated sheet at a cutting depth such that the leading part of the cutting edge of the cutter reaches the flexible member, such that the laminated sheet is cut into a predetermined planar shape wherein the base sheet is cut while the backing sheet is left uncut.

21. A method for cutting a laminated sheet which includes a backing sheet and a base sheet, the method comprising the steps of:

providing a flexible member;

providing a cutter which has a beveled cutting edge, the cutting edge having a leading part;

pressing the laminated sheet with the backing sheet facing and being in contact with the flexible member;

moving the cutter relative to the laminated sheet at a cutting depth such that the leading part of the cutting edge of the cutter reaches the flexible member, such that the laminated sheet is cut into a predetermined planar shape wherein the base sheet is cut while the backing sheet is left uncut; and setting the cutting depth of the cutter relative to the flexible member to be deeper at cutting start and cutting end positions of the cutter than the cutting depth at intermediate cutting positions between the cutting start and cutting end positions.

* * * * *